US009383676B2

(12) United States Patent
Hironaka et al.

(10) Patent No.: US 9,383,676 B2
(45) Date of Patent: Jul. 5, 2016

(54) IMAGE FORMING APPARATUS WITH IMPROVED IMAGE QUALITY

(71) Applicant: Brother Kogyo Kabushiki Kaisha, Nagoya-shi, Aichi-ken (JP)

(72) Inventors: Keita Hironaka, Obu (JP); Satoru Suzuki, Kasugai (JP); Mayu Wakamatsu, Tsushima (JP); Kengo Yada, Seki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/754,771

(22) Filed: Jun. 30, 2015

(65) Prior Publication Data

US 2015/0378276 A1 Dec. 31, 2015

(30) Foreign Application Priority Data

Jun. 30, 2014 (JP) ..... 2014-133610

(51) Int. Cl.

| | |
|---|---|
| ***G03G 15/06*** | (2006.01) |
| ***G03G 15/02*** | (2006.01) |
| ***G03G 15/00*** | (2006.01) |
| *G03G 15/09* | (2006.01) |

(52) U.S. Cl.

CPC ..... *G03G 15/065* (2013.01); *G03G 15/5008* (2013.01); *G03G 15/0935* (2013.01)

(58) Field of Classification Search

CPC ..... G03G 15/065; G03G 15/0935

See application file for complete search history.

(56) References Cited

U.S. PATENT DOCUMENTS

| | | | | |
|---|---|---|---|---|
| 7,366,446 | B2 * | 4/2008 | Sato | G03G 15/5008 399/167 |
| 8,447,194 | B2 * | 5/2013 | Ozeki | G03G 15/0815 399/236 |
| 8,655,229 | B2 * | 2/2014 | Aratachi | G03G 15/0806 399/167 |

FOREIGN PATENT DOCUMENTS

| | | | |
|---|---|---|---|
| JP | 2001-166573 A | | 6/2001 |
| JP | 2001166573 A | * | 6/2001 |
| JP | 2001-194871 A | | 7/2001 |

* cited by examiner

*Primary Examiner* — Clayton E LaBalle
*Assistant Examiner* — Leon W Rhodes, Jr.
(74) *Attorney, Agent, or Firm* — Banner & Witcoff, Ltd.

(57) ABSTRACT

An image forming apparatus is provided with: a controller capable of changing a developing bias, which is to be applied to a developing roller configured to carry developer thereon; a peripheral speed ratio of a developing roller to a photosensitive member; a control method by the controller, and a program for operating the controller. A configuration is provided where the developing roller makes contact with the photosensitive member when a developing bias is made to be lower during the non-developing than during a developing phase. The configuration can suppress press fogging at room temperature and low humidity conditions.

15 Claims, 18 Drawing Sheets

*FIG. 9*

| V0 | Vb | V0-Vb | PERIPHERAL SPEED v | NL PRESS FOGGING | HH REVERSE POLARITY FOGGING | STATE |
|---|---|---|---|---|---|---|
| 850V | 400V | 450V | RAPID | ○ | ○ | C1 |
| | | | SLOW | ○○ | ○ | C2 |
| | 200V | 650V | RAPID | ○○ | × | C3 |
| | | | SLOW | ○○○ | × | C4 |
| 650V | 400V | 250V | RAPID | × | ○○ | C5 |
| | | | SLOW | ○- | ○○ | C6 |
| | 200V | 450V | RAPID | ○ | ○ | C7 |
| | | | SLOW | ○○ | ○ | C8 |

IMAGE FORMING APPARATUS WITH IMPROVED IMAGE QUALITY

CROSS-REFERENCE TO RELATED APPLICATION

This application claims priorities from Japanese Patent Application No. 2014-133610 filed on Jun. 30, 2014, the entire subject matters of which is incorporated herein by reference.

TECHNICAL FIELD

The present disclosure relates to an image forming apparatus having a controller capable of changing a developing bias, which is to be applied to a developing roller configured to carry developer thereon, and a peripheral speed ratio of a developing roller to a photosensitive member, a control method by the controller, and a program for operating the controller.

BACKGROUND

An image forming apparatus has been known which includes a photosensitive member, on which an electrostatic latent image is to be formed, and a developing roller arranged to be spaced from the photosensitive member and is configured to lower a developing bias when a non-image area of the photosensitive member passes through a developing unit, i.e., during non-developing. An example of such image forming apparatus is disclosed in JP-A-2001-166573.

SUMMARY

The inventors found in a test that in a configuration where the developing roller is contacted to the photosensitive member, when a developing bias is made to be lower during the non-developing than during developing, toner movement from the developing roller to the non-image area of the photosensitive member, which is called press fogging, could be suppressed at room temperature and low humidity conditions. Also, the inventors found in the test that when a predetermined control is performed during the non-developing, in addition to the control of lowering the developing bias, the press fogging could be further suppressed.

The present disclosure has been made in view of the above circumstances, and one of objects of the present disclosure to provide an image forming apparatus, a control method and a program capable of satisfactory suppressing press fogging during non-developing.

According to an illustrative embodiment of the present disclosure, there is provided an image forming apparatus including: an image forming unit including: a photosensitive member on which an electrostatic latent image is to be formed; and a developing roller configured to contact the photosensitive member and to supply developer to the electrostatic latent image formed on the photosensitive member; a peripheral speed setting mechanism configured to set a peripheral speed ratio of the developing roller to the photosensitive member to at least a small peripheral speed ratio and a large peripheral speed ratio; a developing bias applying circuit configured to selectively apply a low developing bias or high developing bias to the developing roller; and a controller. The controller is configured to: control the peripheral speed setting mechanism to set the peripheral speed ratio to the small peripheral speed ratio in rotating the developing roller; control the developing bias applying circuit to apply the low developing bias to the developing roller for a predetermined time period; control the developing bias applying circuit to operate in a state in which the high developing bias is applied to the developing roller and the peripheral speed setting mechanism to set to the large peripheral speed ratio after controlling the peripheral speed setting mechanism to set the peripheral speed ratio to the small peripheral speed ratio and the developing bias applying circuit to apply the low developing bias to the developing roller for the predetermined period; and control the image forming unit to supply the developer to the electrostatic latent image formed on the photosensitive member and to transfer the developer on the photosensitive member to a sheet after controlling the developing bias applying circuit to operate in a state in which the high developing bias is applied to the developing roller and the peripheral speed setting mechanism to set to the large peripheral speed ratio. The low developing bias is set to have an absolute value smaller than the high developing bias and to be larger than zero. The small peripheral speed ratio is set to be smaller than the large peripheral speed ratio and to be larger than zero.

According to another illustrative embodiment of the present disclosure, there is provided a method for controlling an image forming apparatus that is provided with an image forming unit including: a photosensitive member on which an electrostatic latent image is to be formed; and a developing roller configured to contact the photosensitive member and to supply developer to the electrostatic latent image formed on the photosensitive member. The method includes: setting a peripheral speed ratio of the developing roller to the photosensitive member to a small peripheral speed ratio in rotating the developing roller; applying a low developing bias to the developing roller for a predetermined time period; applying a high developing bias to the developing roller while setting the peripheral speed ratio to a large peripheral speed ratio after setting the peripheral speed ratio to the small peripheral speed ratio and applying the low developing bias to the developing roller for the predetermined time period; and controlling the image forming unit to supply the developer to the electrostatic latent image formed on the photosensitive member and to transfer the developer on the photosensitive member to a sheet after applying the high developing bias to the developing roller and setting the large speed ratio to the peripheral speed setting mechanism. The low developing bias is set to have an absolute value smaller than the high developing bias and to be larger than zero. The small peripheral speed ratio is set to be smaller than the large peripheral speed ratio and to be larger than zero.

According to still another illustrative embodiment of the present disclosure, there is provided a non-transitory computer-readable recording medium storing computer-readable instructions for an image forming apparatus that is provided with an image forming unit including: a photosensitive member on which an electrostatic latent image is to be formed; a developing roller configured to contact the photosensitive member and to supply developer to the electrostatic latent image formed on the photosensitive member; and a processor. The instructions, when executed by the processor, cause the image forming apparatus to perform: setting a peripheral speed ratio of the developing roller to the photosensitive member to a small peripheral speed ratio in rotating the developing roller; applying a low developing bias to the developing roller for a predetermined time period; applying a high developing bias to the developing roller while setting the peripheral speed ratio to a large peripheral speed ratio after setting the peripheral speed ratio to the small peripheral speed ratio and applying the low developing bias to the developing roller for the predetermined time period; and controlling the image forming unit to supply the developer to the electrostatic latent image formed on the photosensitive member and to transfer the developer on the photosensitive member to a sheet after applying the high developing bias to the developing roller and setting the peripheral speed ratio to the large peripheral speed ratio. The low developing bias is set to have an absolute value smaller than the high developing bias and to be larger than zero. The small peripheral speed ratio is set to be smaller than the large peripheral speed ratio and to be larger than zero.

BRIEF DESCRIPTION OF THE DRAWINGS

In the accompanying drawings:

FIG. 8 is a timing chart showing switching timings of a peripheral speed, a developing bias, the surface potential at a nip portion, and the like;

FIG. 9 is a table showing a test result checking whether press fogging and reverse polarity fogging occurs or not;

DETAILED DESCRIPTION

Figure 1:
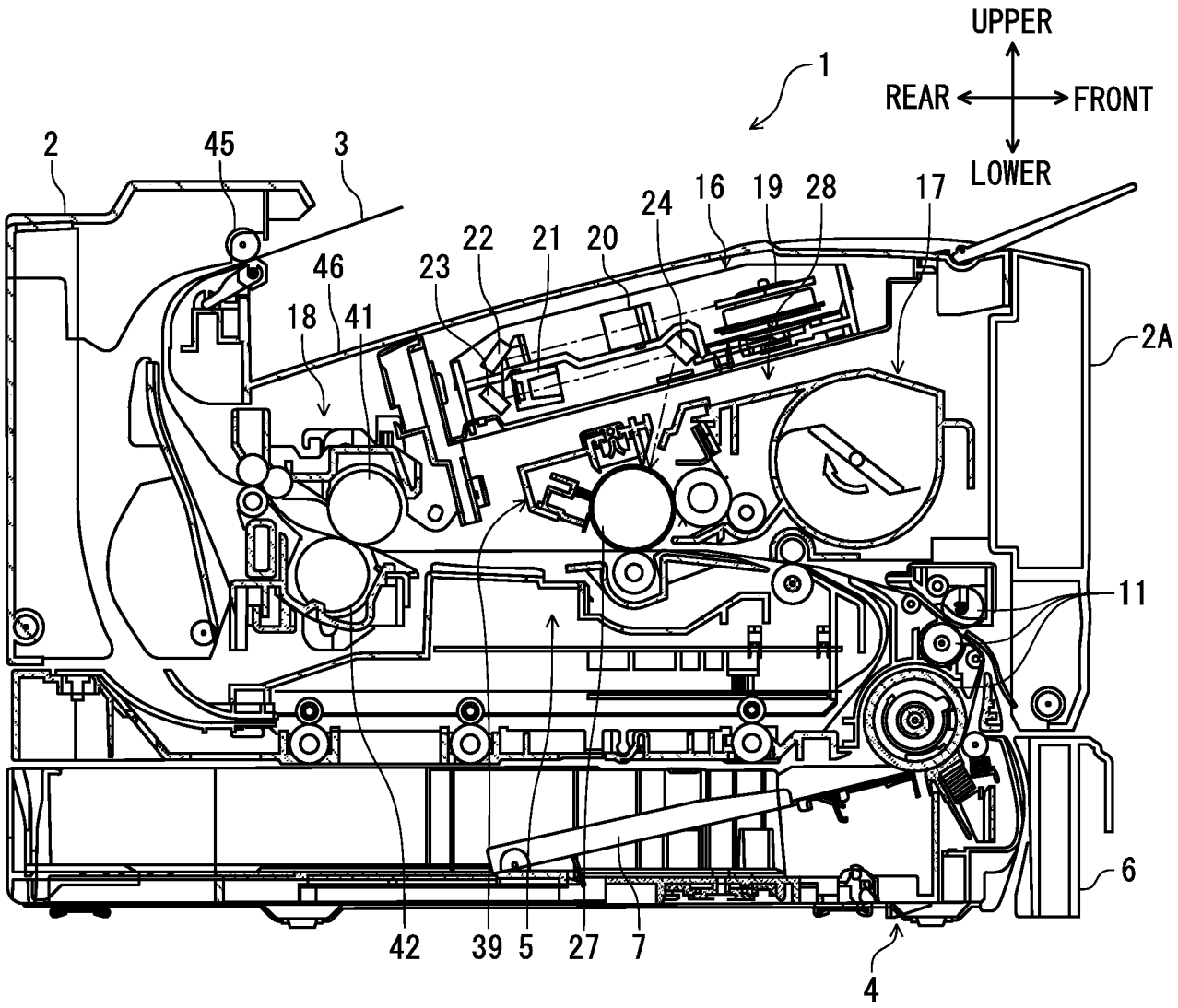
FIG. 1 is a side sectional view illustrating an image forming apparatus according to an illustrative embodiment of the present disclosure.

Hereinafter, a laser printer 1, which is an example of the image forming apparatus according to an illustrative embodiment of the present disclosure, will be described in detail with reference to the drawings. In the following descriptions, an overall configuration of the laser printer 1 will be briefly described and thereafter, operation of the laser printer 1 will be described in detail.

Also, in the following descriptions, directions are described from a viewpoint of a user who uses the laser printer 1. That is, in FIG. 1, a right side is referred to as a 'front side', a left side is referred to as a 'rear side', a front side of the drawing sheet is referred to as a 'left side' and an inner side of the drawing sheet is referred to as a 'right side'. Also, an upper-lower direction of the drawing sheet is referred to as an 'upper-lower direction.'

As shown in FIG. 1, the laser printer 1 has, in a main body casing 2, a feeder unit 4 configured to feed a sheet 3, and an image forming unit 5 configured to form an image on the sheet 3.

The feeder unit 4 has a sheet feeding tray 6 detachably mounted to a lower part in the main body casing 2, a sheet pressing plate 7 provided in the sheet feeding tray 6, and a variety of rollers 11 configured to convey the sheet 3 and the like. The sheet 3 accommodated in the sheet feeding tray 6 is inclined upwards by the sheet pressing plate 7 and is conveyed to the image forming unit 5 by the various rollers 11.

The image forming unit 5 has a scanner unit 16, a process cartridge 17, and a fixing unit 18.

The scanner unit 16 is provided at an upper part in the main body casing 2. The scanner unit 16 is provided with a light emitting unit (not shown), a polygon mirror 19, lenses 20, 21, reflectors 22, 23, 24, and the like. In the scanner unit 16, a laser light based on image data passes through a route shown with a dashed-two dotted line, and is illuminated onto a surface of a photosensitive drum 27 by high speed scanning.

The process cartridge 17 is configured to be detachable from the main body casing 2. The process cartridge 17 can be mounted and demounted to and from the main body casing 2 by opening a front cover 2A provided at a front side of the main body casing 2. The process cartridge 17 is provided with a developing cartridge 28, and a drum unit 39.

Figure 2:
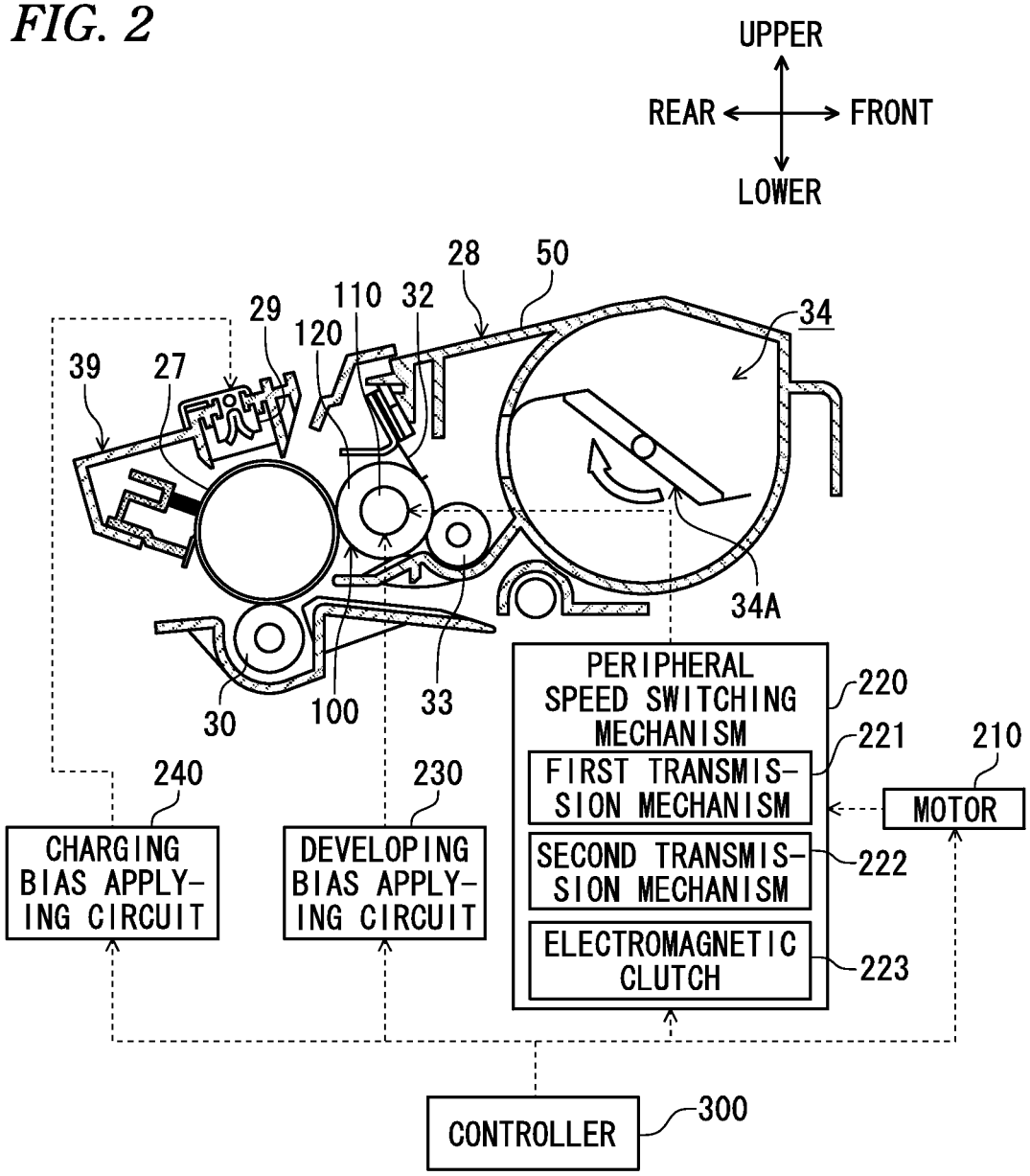
FIG. 2 illustrates components of the image forming apparatus, such as a process cartridge and a controller.

The developing cartridge 28 is configured to be mounted and demounted to and from the main body casing 2 in a state being mounted to the drum unit 39. The developing cartridge 28 may be configured to be mounted and demounted to and from the drum unit 39 fixed to the main body casing 2. As shown in FIG. 2, the developing cartridge 28 has a housing 50, a developing roller 100, a layer thickness regulation blade 32 and a supply roller 33, and the housing 50 is formed with a toner accommodation chamber 34. The developing roller 100 has a rotary shaft 110 made of metal, and an elastic layer 120 configured to cover an outer periphery of the rotary shaft 110, and the elastic layer 120 is pressed and contacted to the photosensitive drum 27.

In the developing cartridge 28, positively charged toner in the toner accommodation chamber 34, which is an example of the developer, is stirred with an agitator 34A, and is then supplied to the developing roller 100 by the supply roller 33. At this time, the toner is positively friction-charged between the supply roller 33 and the developing roller 100. As the developing roller 100 is rotated, the toner supplied onto the developing roller 100 is introduced between the layer thickness regulation blade 32 and the developing roller 100, is further friction-charged and is carried on the developing roller 100, as a thin layer having a predetermined thickness.

The drum unit 39 is provided with the photosensitive drum 27, which is an example of the photosensitive member, a scorotron-type charger 29 and a transfer roller 30 to which a transfer bias is to be applied. In the drum unit 39, a surface of the photosensitive drum 27 is uniformly positively charged by the charger 29, and is then exposed by the high speed scanning of the laser light emitted from the scanner unit 16. Thereby, a potential of the exposed part is lowered, so that an electrostatic latent image based on the image data is formed.

Subsequently, as the developing roller 100 is rotated, the positively charged toner carried on the surface of the developing roller 100 is supplied to the electrostatic latent image formed on the surface of the photosensitive drum 27, so that a toner image is formed on the surface of the photosensitive drum 27. After that, the sheet 3 is conveyed between the photosensitive drum 27 and the transfer roller 30, so that the toner image carried on the surface of the photosensitive drum 27 is transferred to the sheet 3.

As shown in FIG. 1, the fixing unit 18 has a heating roller 41 and a pressing roller 42 that is configured to press the heating roller 41. In the fixing unit 18, the toner transferred to the sheet 3 is heat-fixed while the sheet 3 passes between the heating roller 41 and the pressing roller 42. The sheet 3 heat-fixed in the fixing unit 18 is conveyed to sheet discharge rollers 45 arranged downstream of the fixing unit 18 and is sent to a sheet discharge tray 46 from the sheet discharge rollers 45.

In the following, a controller 300, which is an example of the controller becoming a feature of the present disclosure, is described in detail.

As shown in FIG. 2, the laser printer 1 has a motor 210, a peripheral speed setting mechanism 220, which is an example of the peripheral speed setting mechanism, a developing bias applying circuit 230, which is an example of the developing bias applying unit, a charging bias applying circuit 240, which is an example of the charging bias applying unit, and a controller 300.

The motor 210 is a driving source for supplying a driving force to the photosensitive drum 27, the developing roller 100 and the like, and is connected to the developing roller 100 via the peripheral speed setting mechanism 220.

The peripheral speed setting mechanism 220 is a mechanism for setting a peripheral speed v of the developing roller 100 to at least a high peripheral speed v1 and a low peripheral speed v2 lower than the high peripheral speed v1 and larger than zero (0). In this way, the peripheral speed v of the developing roller 100 is set to the low peripheral speed v2 by the peripheral speed setting mechanism 220, so that it is possible to prolong the lifetime of the toner.

Here, in this illustrative embodiment, the rotating speed of the photosensitive drum 27 is set to be constant (to be the same) during developing and during non-developing. For this reason, in response to switching the peripheral speed v of the developing roller by the peripheral speed setting mechanism 220, a peripheral speed ratio (peripheral speed of the developing roller 100/peripheral speed of the photosensitive drum 27) of the developing roller 100 to the photosensitive drum 27 is changed. That is, the cases where the peripheral speed v is the high peripheral speed v1 and the low peripheral speed v2 correspond to cases where the peripheral speed ratio of the developing roller 100 to the photosensitive drum 27 is large and small, respectively.

The high peripheral speed v1 may be set to a speed higher than a peripheral speed v3 of the photosensitive drum 27, and the low peripheral speed v2 may be set to a speed lower than the peripheral speed v3 of the photosensitive drum 27. For example, a ratio of the high peripheral speed v1, the peripheral speed v3 and the low peripheral speed v2 may be set to 1.3:1:0.3. Also, both the high peripheral speed v1 and the low peripheral speed v2 may be set to be higher or lower than the peripheral speed v3.

Specifically, the peripheral speed setting mechanism 220 has a first transmission mechanism 221 configured to have a first speed transmission ratio for rotating the developing roller 100 with the high peripheral speed v1, a second transmission mechanism 222 configured to have a second speed transmission ratio for rotating the developing roller 100 with the low peripheral speed v2, and an electromagnetic clutch 223 configured to switch a transmission route of the driving force from the motor 210 to the first transmission mechanism 221 or second transmission mechanism 222. In the peripheral speed setting mechanism 220, when the electromagnetic clutch 223 is OFF, the driving force from the motor 210 is transmitted to the developing roller 100 via the second transmission mechanism 222, and when the electromagnetic clutch 223 is ON, the driving force from the motor 210 is transmitted to the developing roller 100 via the first transmission mechanism 221.

The developing bias applying circuit 230 is a circuit for applying a positive developing bias Vb to the developing roller 100, and is appropriately controlled by the controller 300. Specifically, the developing bias applying circuit 230 is controlled by the controller 300, so that the developing bias Vb, which is to be applied to the developing roller 100, is switched to a high developing bias Vb1 and a low developing bias Vb2 lower than the high developing bias Vb1 and greater than zero (0).

The charging bias applying circuit 240 is a circuit for applying a positive charging bias Vc to the charger 29, and is appropriately controlled by the controller 300. Specifically, the charging bias applying circuit 240 is controlled by the controller 300, so that the charging bias Vc, which is to be applied to the charger 29, is switched to a high charging bias Vc1 and a low charging bias Vc2 lower than the high charging bias Vc1 and greater than zero (0). In this way, the charging bias Vc is set to the low charging bias Vc2, so that it is possible to prolong the lifetime of the photosensitive drum 27.

The respective biases may be controlled based on a voltage or current. Also, when the charging bias Vc is set to the high charging bias Vc1, a surface potential V0 of the photosensitive drum 27 becomes a positive high surface potential V01, and when the charging bias Vc is set to the low charging bias Vc2, the surface potential V0 of the photosensitive drum 27 becomes a positive low surface potential V02 lower than the high surface potential V01.

The controller 300 is configured by electrical components such as a CPU (Central Processing Unit), a storage having a RAM (Random Access Memory), a ROM (Read Only Memory) and the like, and an input/output circuit. The controller 300 is configured to mainly control the motor 210, the peripheral speed setting mechanism 220, the developing bias applying circuit 230 and the charging bias applying circuit 240.

Figure 3:
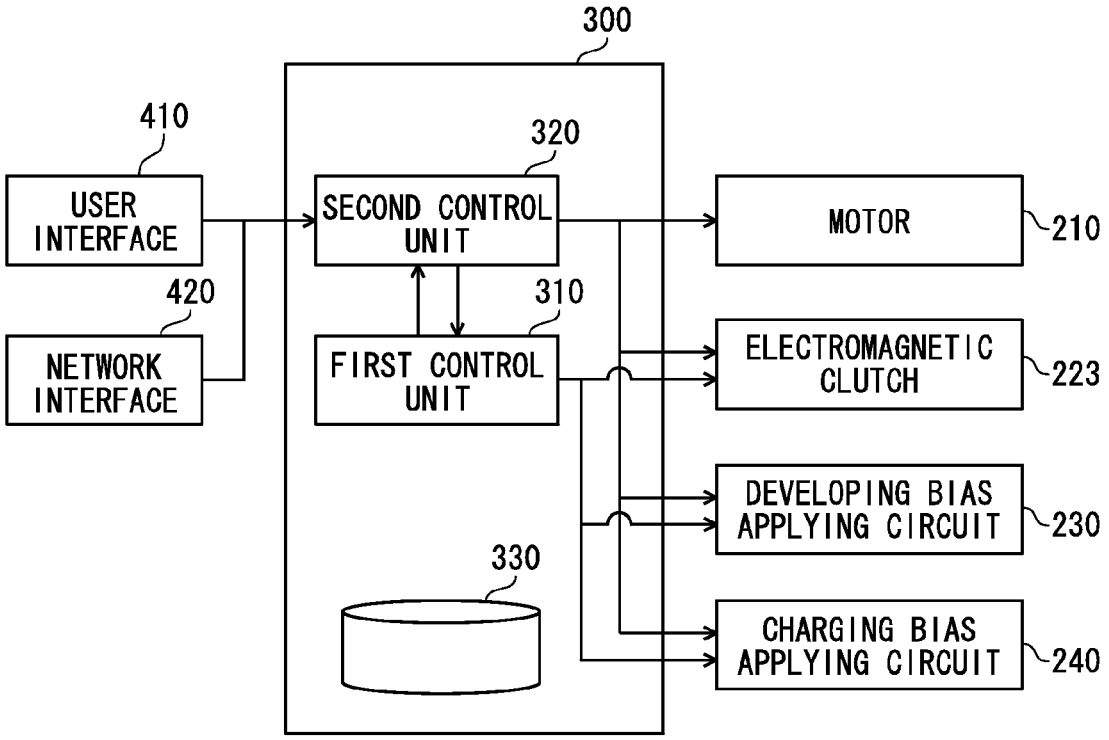
FIG. 3 is a block diagram showing a configuration of the controller.

Specifically, as shown in FIG. 3, the controller 300 has a first control unit 310, a second control unit 320, and a storage 330. In other words, the controller 300 is configured to operate based on a program stored in the storage 330, thereby functioning as the first control unit 310 and the second control unit 320.

The first control unit 310 has a function of executing control processing under developing of setting the developing bias Vb to the high developing bias Vb1, the peripheral speed v to the high peripheral speed v1 and the charging bias Vc to the high charging bias Vc1 during the developing. Also, the first control unit 310 has a function of executing upshift processing for shifting from control processing under non-developing to the control processing under developing, which will be described later. Specifically, in the upshift processing, the first control unit 310 is configured to switch the developing bias Vb from the low developing bias Vb2 to the high developing bias Vb1, the peripheral speed v from the low peripheral speed v2 to the high peripheral speed v1, and the charging bias Vc from the low charging bias Vc2 to the high charging bias Vc1. The timings at which the respective values are switched will be described in detail later.

Specifically, the first control unit 310 is configured to control the developing bias applying circuit 230 so that the developing bias Vb becomes the high developing bias Vb1, to turn on the electromagnetic clutch 223 so that the peripheral speed v becomes the high peripheral speed v1, and to control the charging bias applying circuit 240 so that the charging bias Vc becomes the high charging bias Vc1.

The second control unit 320 has a function of executing the control processing under non-developing of setting the developing bias Vb to the low developing bias Vb2, the peripheral speed v to the low peripheral speed v2 and the charging bias Vc to the low charging bias Vc2 for a predetermined time period during the non-developing. Also, the second control unit 320 has a function of executing downshift processing for shifting from the control processing under developing to the control processing under non-developing. Specifically, in the downshift processing, the second control unit 320 is configured to switch the developing bias Vb from the high developing bias Vb1 to the low developing bias Vb2, the peripheral speed v from the high peripheral speed v1 to the low peripheral speed v2, and the charging bias Vc from the high charging bias Vc1 to the low charging bias Vc2. The timings at which the respective values are switched will be described in detail later.

Specifically, the second control unit 320 is configured to control the developing bias applying circuit 230 so that the developing bias Vb becomes the low developing bias Vb2, to turn off the electromagnetic clutch 223 so that the peripheral speed v becomes the low peripheral speed v2, and to control the charging bias applying circuit 240 so that the charging bias Vc becomes the low charging bias Vc2.

Further, the second control unit 320 has a function of switching the peripheral speed v from zero (0) to the low peripheral speed v2, the developing bias Vb from zero (0) to the low developing bias Vb2 and the charging bias Vc from zero (0) to the low charging bias Vc2 when it shifts to the control processing under non-developing from a state such as a sleep mode and a standby mode where the operation of the motor 210 is stopped. Specifically, the second control unit 320 is configured to drive the motor 210 at a state where the electromagnetic clutch 223 is OFF, so as to switch the peripheral speed v from zero (0) to the low peripheral speed v2. Also, the second control unit 320 has a function of switching the peripheral speed v, the developing bias Vb and the charging bias Vc to zero (0) from the control processing under non-developing.

Here, the sleep mode is a mode that is set when an instruction and the like are not received for a predetermined time period in the standby mode (which will be described later), for example. In the sleep mode, the energization to the motor 210 and the heating roller 41 is OFF, and the bias applying to the charger 29, the developing roller 100 and the like is also OFF. Also, the standby mode is a mode that is set after an ending mode is over (which will be described in detail later), for example. In the standby mode, the energization to the motor 210 is OFF, the bias applying to the charger 29, the developing roller 100 and the like is OFF, and the heating roller 41 is kept at a preliminary temperature lower than a fixing temperature (temperature for heat-fixing).

Figure 4:
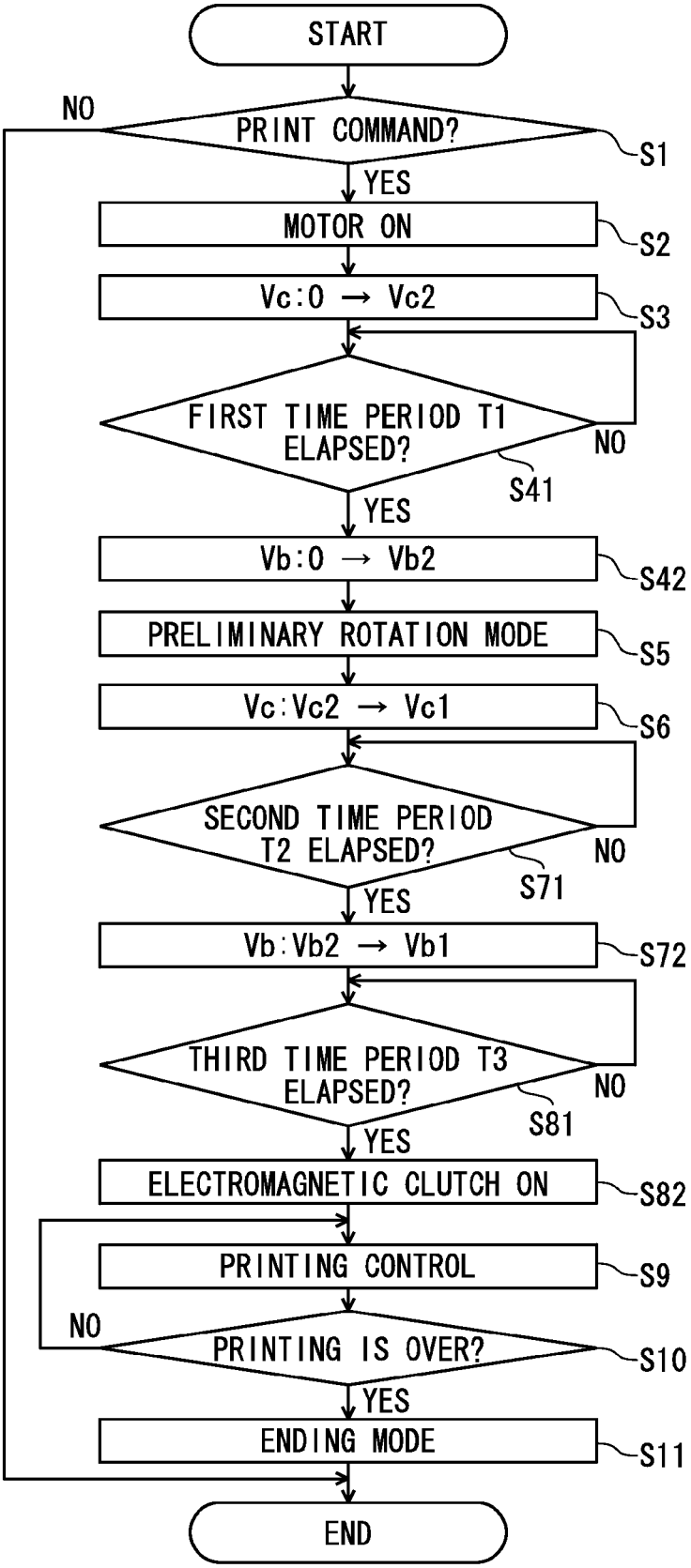
FIG. 4 is a flowchart showing operations of the controller.
Figure 6:
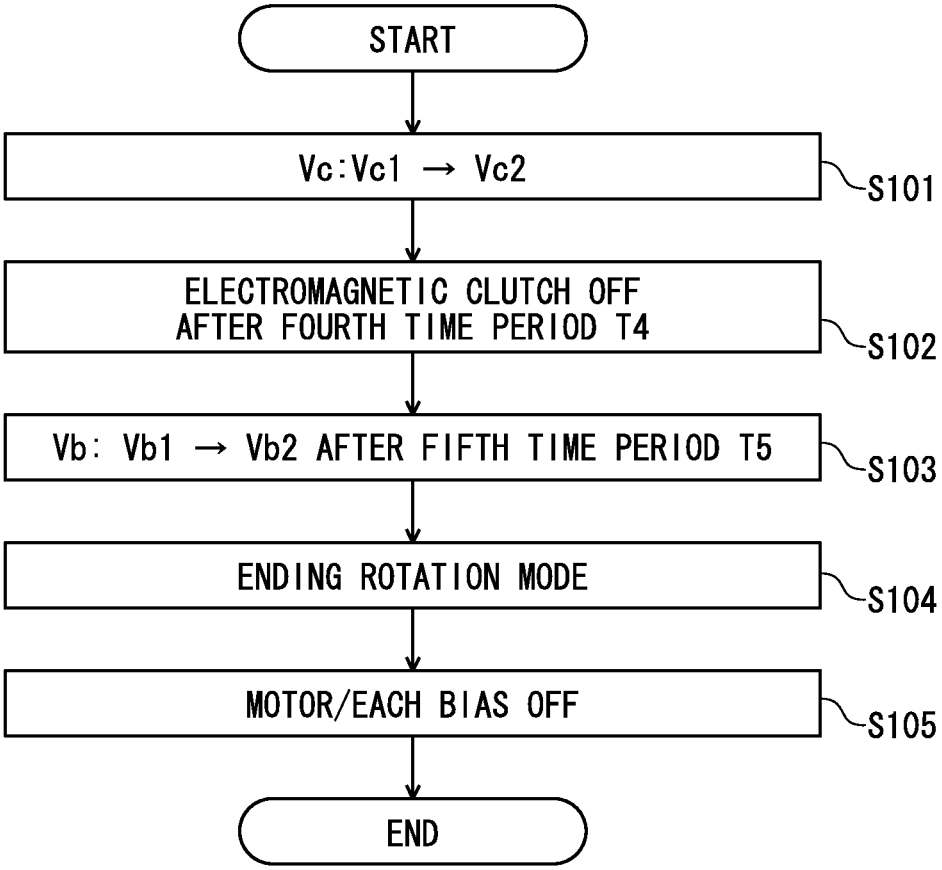
FIG. 6 is a flowchart showing an ending mode.

In the storage 330, a program as shown with flowcharts shown in FIGS. 4 and 6 is stored.

Subsequently, the operations of the first control unit 310 and second control unit 320 of the controller 300 are described in detail. In the following descriptions, since the well-known methods are preferred to be adopted in regards to the sheet feeding control, the exposure control and the fixing control in the printing control, the descriptions thereof are omitted.

The flowchart shown in FIG. 4 is implemented by a shift instruction from the sleep mode or standby mode, for example. As shown in FIG. 4, the second control unit 320 first determines whether a print command is received by receiving a signal from the user interface 410 (a button, a touch panel and the like provided for the laser printer 1) or network interface 420 (S1). In response to receiving the signal and determining that a print command is received (S1: Yes), the second control unit 320 turns on the motor 210 at a state where the electromagnetic clutch 223 is OFF (S2). Thereby, the photosensitive drum 27, the developing roller 100, the agitator 34A and the like start to rotate. In the meantime, at this time, since the second control unit 320 does not turn on the electromagnetic clutch 223, the developing roller 100 is rotated at the low peripheral speed v2.

Figure 7A:
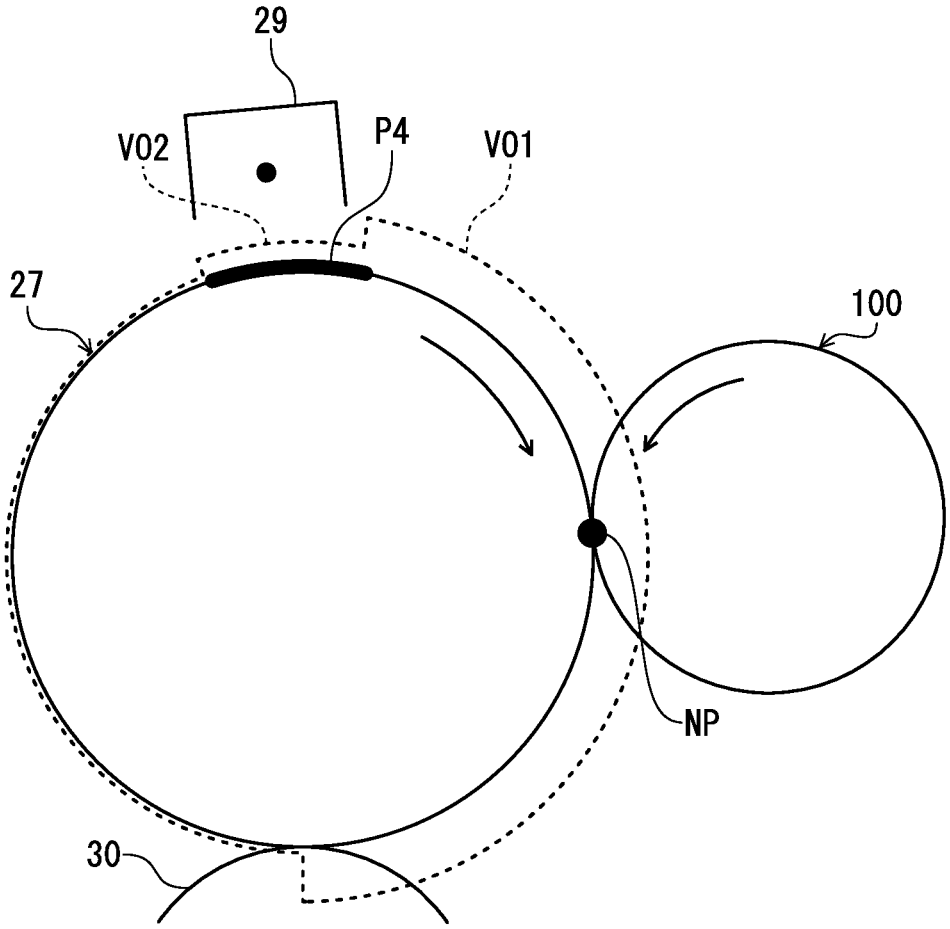
FIGS. 7A to 7C illustrate a change in the surface potential of the photosensitive drum during the ending mode.
Figure 7B:
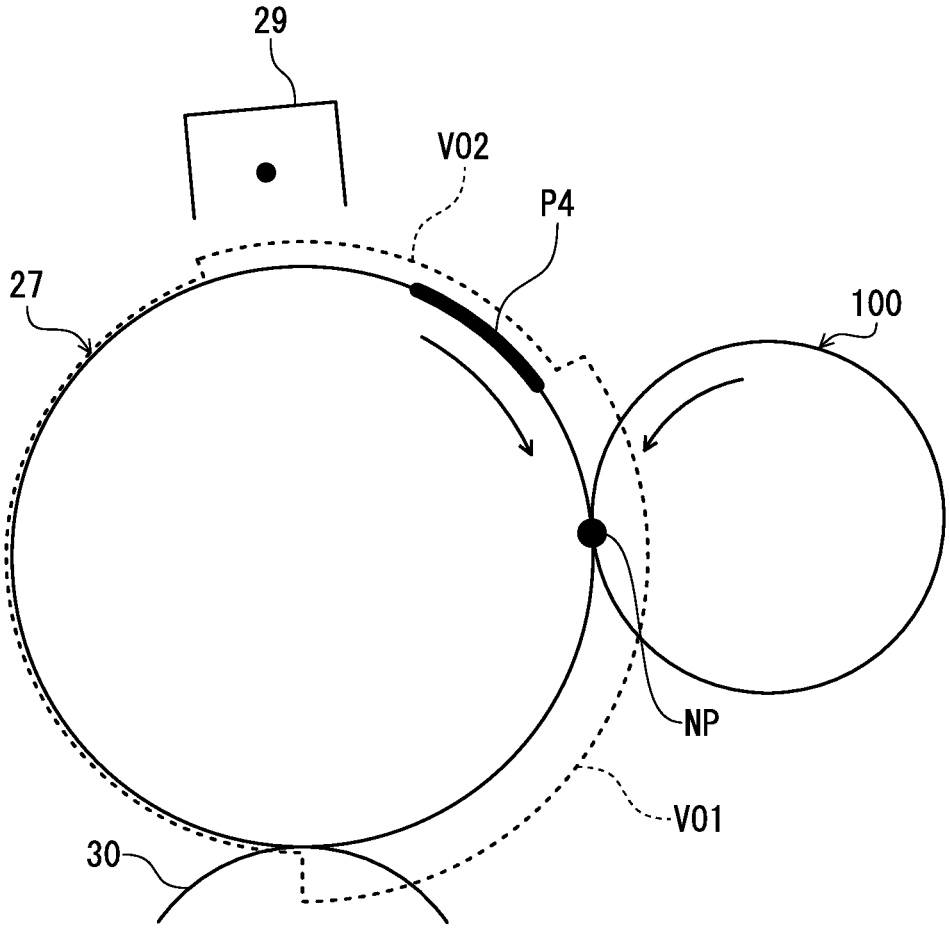
Figure 7C:
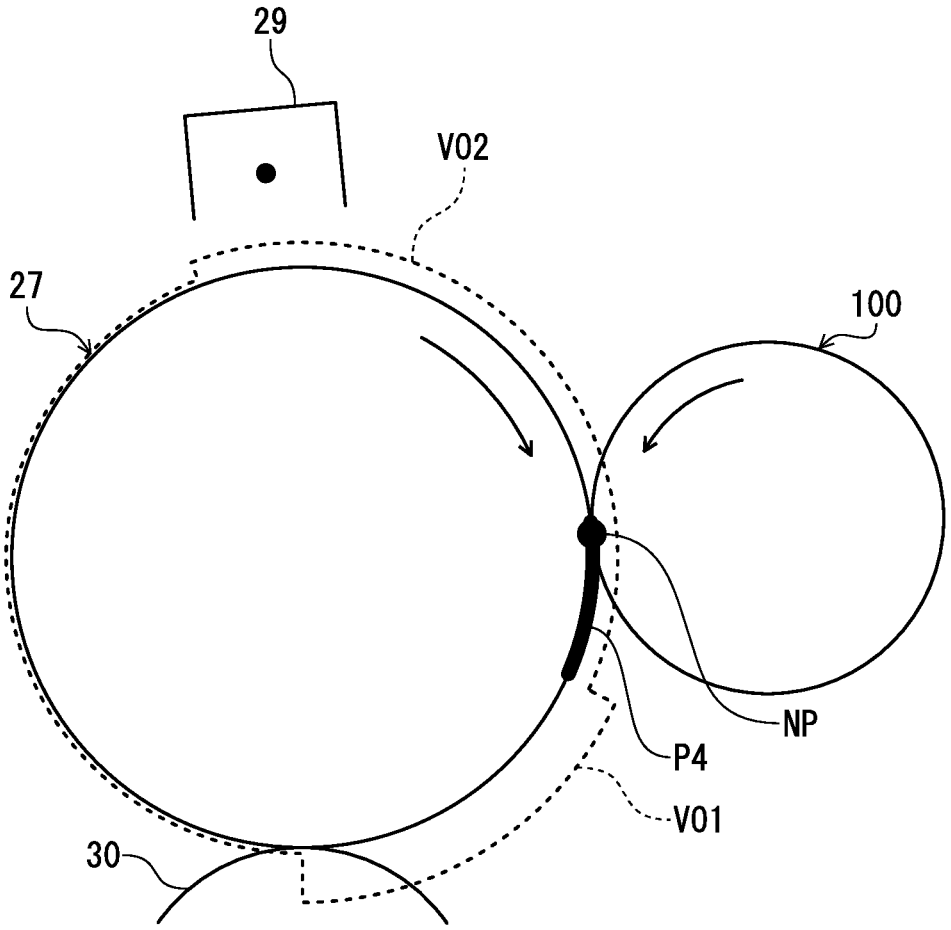

After step S2, the second control unit 320 switches the charging bias Vc from zero (0) to the low charging bias Vc2 (S3). Thereby, the surface potential V0 of a part of the photosensitive drum 27, which faces the charger 29, is switched from zero (0) to the low surface potential V02 (refer to FIG. 5A). In FIGS. 5A-5E and in FIGS. 7A-7C, the broken line indicates the surface potential of the photosensitive drum 27, and the potential is higher as it is more distant from the photosensitive drum 27.

After step S3, the second control unit 320 determines whether a first time period T1 elapses from the setting of the charging bias Vc in step S3 (S41).

In response to determining in step S41 that the first time period T1 elapses from the setting of the charging bias Vc in step S3, the second control unit 320 switches the developing bias Vb from zero (0) to the low developing bias Vb2, thereby starting the control processing under non-developing (S42). Here, the first time period T1 is set as a time period or longer necessary for a part (refer to a charging start part P1 shown with the thick line in FIGS. 5A and 5B) of the surface of the photosensitive drum 27, which faces the charger 29 at a point of time that the charging bias Vc is switched from zero (0) to the low charging bias Vc2, to move from a position at which the part faces the charger 29 to a nip portion NP between the developing roller 100 and the photosensitive drum 27. Thereby, it is possible to suppress movement of the toner on the developing roller 100 to a non-charged part P2 of the photosensitive drum 27, which is caused due to the applying of the developing bias Vb.

After step S42, the second control unit 320 keeps the current state for a predetermined time period, thereby preliminarily rotating the photosensitive drum 27, the developing roller 100, the agitator 34A and the like for the predetermined time period (S5). Thereby, the toner in the toner accommodation chamber 34 is stirred by the agitator 34A.

After step S5, the first control unit 310 switches the charging bias Vc from the low charging bias Vc2 to the high charging bias Vc1 (S6). Thereby, the surface potential V0 of the photosensitive drum 27 is switched from the low surface potential V02 to the high surface potential V01 (refer to FIG. 5C). Also, the charging bias Vc is switched, so that the upshift processing is enabled to start and the control processing under non-developing is over.

After step S6, the first control unit 310 determines whether a second time period (first preset time period) T2 elapses from the switching of the charging bias Vc in step S6 (S71).

In response to determining in step S71 that the second time period T2 elapses from the switching of the charging bias Vc in step S6, the first control unit 310 switches the developing bias Vb from the low developing bias Vb2 to the high developing bias Vb1 (S72).

Figure 5A:
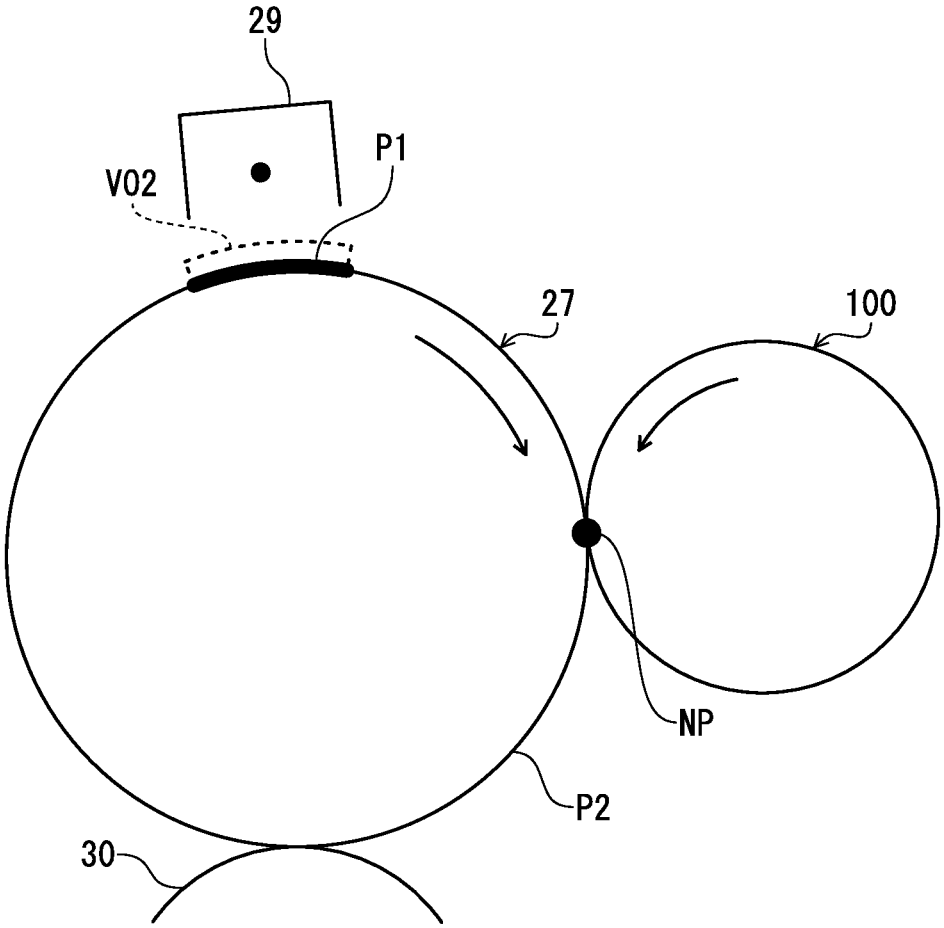
FIGS. 5A to 5E illustrate a change in a surface potential of a photosensitive drum at the start of print.
Figure 5B:
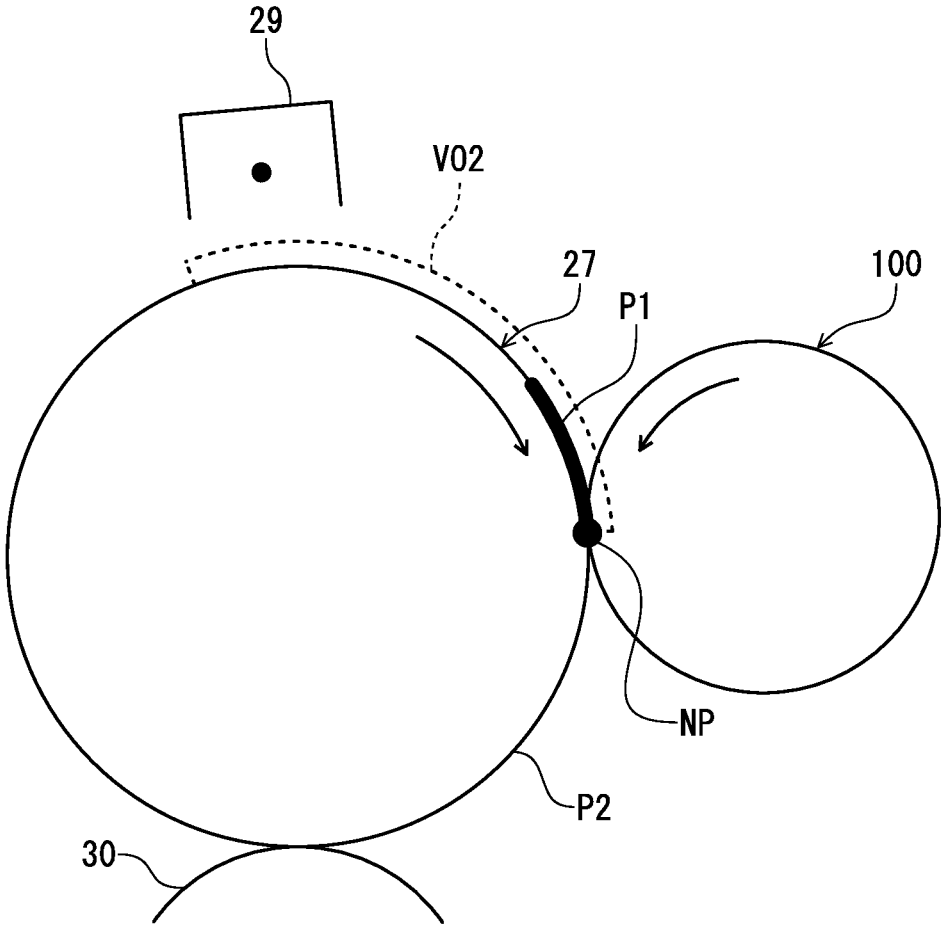
Figure 5C:
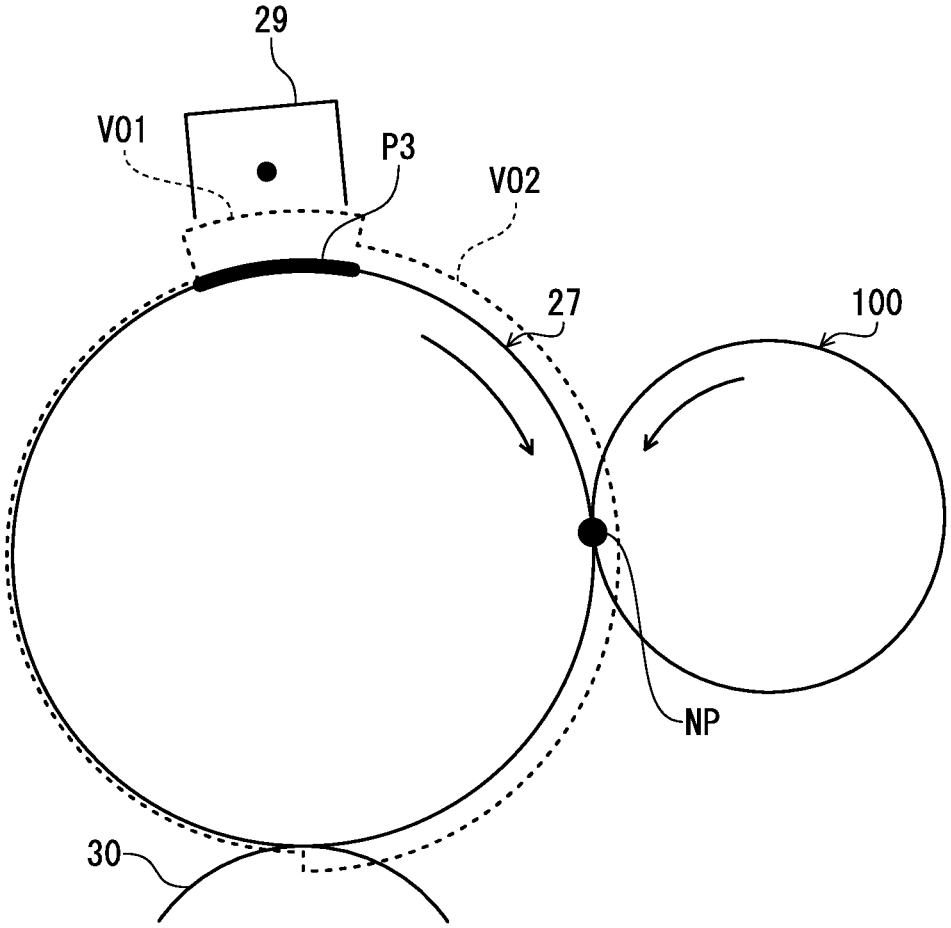
Figure 5D:
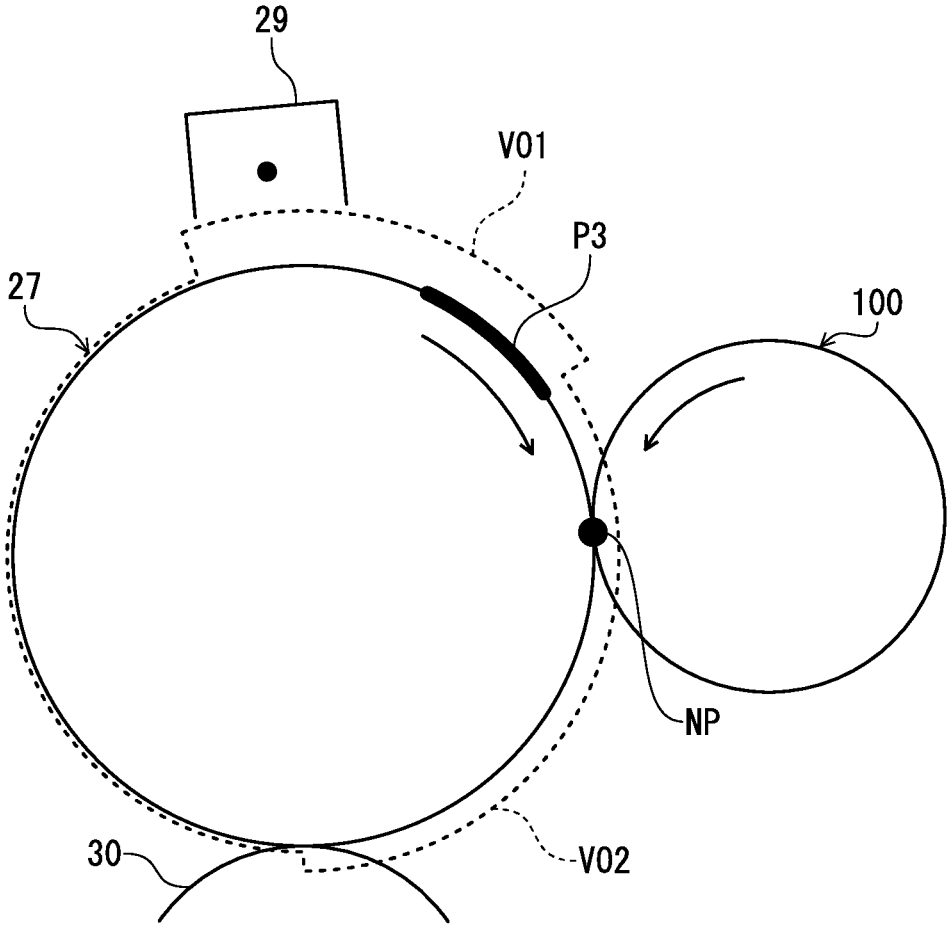
Figure 5E:
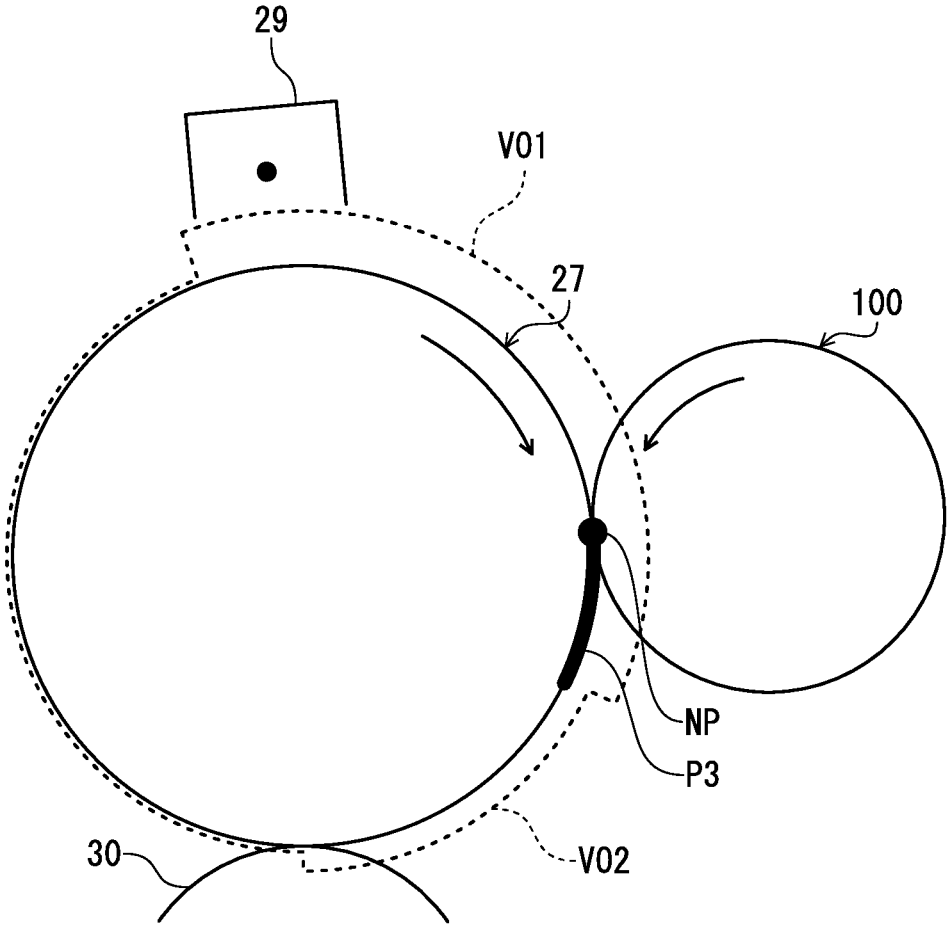

Here, the second time period T2 is set as a time period shorter than the time period necessary for a part (refer to a high potential part P3 shown with the thick line in FIG. 5C) of the surface of the photosensitive drum 27, which faces the charger 29 at a point of time that the charging bias Vc is switched from the low charging bias Vc2 to the high charging bias Vc1, to move from a position at which the part faces the charger 29 to the nip portion NP between the developing roller 100 and the photosensitive drum 27 (refer to FIG. 5D).

That is, when shifting from the control processing under non-developing to the control processing under developing, the first control unit 310 first switches the charging bias Vc from the low charging bias Vc2 to the high charging bias Vc1, and then switches the developing bias Vb from the low developing bias Vb2 to the high developing bias Vb1 before the high potential part P3 of the surface of the photosensitive drum 27, which faces the charger 29 upon the switching, reaches the developing roller 100. In other words, the first control unit 310 switches the developing bias Vb from the low developing bias Vb2 to the high developing bias Vb1 before the surface potential V0 of the photosensitive drum 27 at the nip portion NP between the photosensitive drum 27 and the developing roller 100 is switched from the low surface potential V02 to the high surface potential V01.

After step S72, the first control unit 301 determines whether a third time period (second preset time period) T3 elapses from the switching of the charging bias Vc in step S6 (S81).

In response to determining in step S81 that the third time period T3 elapses from the switching of the charging bias Vc in step S6, the first control unit 301 turns on the electromagnetic clutch 223 (S82). Thereby, the peripheral speed v of the developing roller 100 is switched from the low peripheral speed v2 to the high peripheral speed v1. Here, the third time period T3 is set as a time period longer than the time period necessary for the high potential part P3 to move from the position at which it faces the charger 29 to the nip portion NP between the developing roller 100 and the photosensitive drum 27 (refer to FIG. 5E).

That is, when shifting from the control processing under non-developing to the control processing under developing, the first control unit 310 first switches the charging bias Vc from the low charging bias Vc2 to the high charging bias Vc1, and then switches the peripheral speed v from the low peripheral speed v2 to the high peripheral speed v1 after the high potential part P3 of the surface of the photosensitive drum 27, which faces the charger 29 upon the switching, reaches the developing roller 100 (a downstream end of the high potential part P3 with respect to a rotating direction of the photosensitive drum 27 exits from the nip portion NP). In other words, the first control unit 310 switches the peripheral speed v from the low peripheral speed v2 to the high peripheral speed v1 after the surface potential V0 of the photosensitive drum 27 at the nip portion NP between the photosensitive drum 27 and the developing roller 100 is switched from the low surface potential V02 to the high surface potential V01.

The processing of steps S6 to S82 is executed in this way, so that the switching is made in order of the charging bias Vc-->the developing bias Vb-->the surface potential V0 at the nip portion NP (the high potential part P3 reaches the nip portion NP)-->the peripheral speed v. The peripheral speed v is switched, so that the upshift processing is over and the control processing under developing is enabled to start.

After step S82, the first control unit 310 executes the printing control for one sheet 3 of the number of sheets to be printed, which is designated in the print command (S9). Specifically, in step S9, when printing a first sheet 3, the controller 300 emits the laser light from the scanner unit 16 if a predetermined standby time period elapses from the ON setting of the electromagnetic clutch 223 in steps S81 and S82. Here, the standby time period is a time period or longer necessary for the peripheral speed v to stabilize to the high peripheral speed v1. Thereby, when shifting from the control processing under non-developing to the control processing under developing, the first control unit 310 can complete the switching of the peripheral speed v before an electrostatic latent image forming area on the photosensitive drum 27 reaches the developing roller 100.

After step S9, the first control unit 310 determines whether the printing is performed for all the number of sheets to be printed, which is designated in the print command (S10). In response to determining that the printing is not over (S10: No), the first control unit 310 returns to the processing of step S9, and in response to determining that the printing is over (S10: Yes), the first control unit 310 shifts to the ending mode (S11).

In the meantime, after the ending mode is over or when a print command is not received in step S1 (No), the second control unit 320 ends this control.

As shown in FIG. 6, in the ending mode, the second control unit 320 first switches the charging bias Vc from the high charging bias Vc1 to the low charging bias Vc2 (S101). The charging bias Vc is switched, so that the downshift processing is enabled to start and the control processing under developing is over.

After step S101, the second control unit 320 determines whether a fourth time period (fourth preset time period) T4 elapses from the switching of the charging bias Vc in step S101 (S1021).

In response to determining in step S1021 that the fourth time period (fourth preset time period) T4 elapses from the switching of the charging bias Vc in step S101, the second control unit 320 turns off the electromagnetic clutch 223 (S1022). Thereby, the peripheral speed v of the developing roller 100 is switched from the high peripheral speed v1 to the low peripheral speed v2. Here, the fourth time period T4 is set as a time period shorter than a time period necessary for a part (low potential part P4 shown with the thick line in FIG. 7A) of the surface of the photosensitive drum 27, which faces the charger 29 at a point of time that the charging bias Vc is switched from the high charging bias Vc1 to the low charging bias Vc2, to move from a position at which the part faces the charger 29 to the nip portion NP between the developing roller 100 and the photosensitive drum 27 (refer to FIG. 7B).

That is, when shifting from the control processing under developing to the control processing under non-developing, the second control unit 320 first switches the charging bias Vc from the high charging bias Vc1 to the low charging bias Vc2, and then switches the peripheral speed v from the high peripheral speed v1 to the low peripheral speed v2 before the low potential part P4 of the surface of the photosensitive drum 27, which faces the charger 29 upon the switching, reaches the developing roller 100. In other words, the second control unit 320 switches the peripheral speed v from the high peripheral speed v1 to the low peripheral speed v2 before the surface potential V0 of the photosensitive drum 27 at the nip portion NP between the photosensitive drum 27 and the developing roller 100 is switched from the high surface potential V01 to the low surface potential V02.

The processing of steps S1021 and S1022 is executed after the printing is performed for all the number of sheets to be printed, which is designated in the print command. Therefore, substantially, when shifting from the control processing under developing to the control processing under non-developing, the second control unit 320 switches the peripheral speed v after the electrostatic latent image forming area on the photosensitive drum 27, which corresponds to the image forming area of the sheet 3, exits from the developing roller 100.

After step S1022, the second control unit 302 determines whether a fifth time period (third preset time period) T5 elapses from the switching of the charging bias Vc in step S101 (S1031).

In response to determining in step S1031 that the fifth time period (third preset time period) T5 elapses from the switching of the charging bias Vc in step S101, the second control unit 302 switches the developing bias Vb from the high developing bias Vb1 to the low developing bias Vb2 (S1032). Here, the fifth time period T5 is set as a time period longer than a time period necessary for the low potential part P4 of the surface of the photosensitive drum 27, which faces the charger 29 at a point of the time that the charging bias Vc is switched from the high charging bias Vc1 to the low charging bias Vc2, to move from the position at which the part faces the charger 29 to the nip portion NP between the photosensitive drum 27 and the developing roller 100 (refer to FIG. 7C).

That is, when shifting from the control processing under developing to the control processing under non-developing, the second control unit 320 first switches the charging bias Vc from the high charging bias Vc1 to the low charging bias Vc2, and then switches the developing bias Vb from the high developing bias Vb1 to the low developing bias Vb2, after the low potential part P4 of the surface of the photosensitive drum 27, which faces the charger 29 upon the switching, reaches the developing roller 100 (a downstream end of the low potential part P4 with respect to a rotating direction of the photosensitive drum 27 exits from the nip portion NP). In other words, the second control unit 320 switches the developing bias Vb from the high developing bias Vb1 to the low developing bias Vb2 after the surface potential V0 of the photosensitive drum 27 at the nip portion NP between the photosensitive drum 27 and the developing roller 100 is switched from the high surface potential V01 to the low surface potential V02.

The processing of steps S101 to S1032 is executed in this way, so that the switching is made in order of the charging bias Vc-->the peripheral speed v-->the surface potential V0 at the nip portion NP (the low potential part P4 reaches the nip portion NP)-->the developing bias Vb. The developing bias Vb is switched, so that the downshift processing is over and the control processing under non-developing is enabled to start.

After step S1032, the second control unit 320 executes an ending rotation mode for a predetermined time period, in which the photosensitive drum 27, the developing roller 100, the agitator 34A and the like are rotated (S104). After step S104, the second control unit 320 turns off the motor 210 and also turns off the applying of the respective biases to the developing roller 100 and the charger 29 (S105). The processing of step S105 is executed, so that the control processing under non-developing is over.

Figure 8:
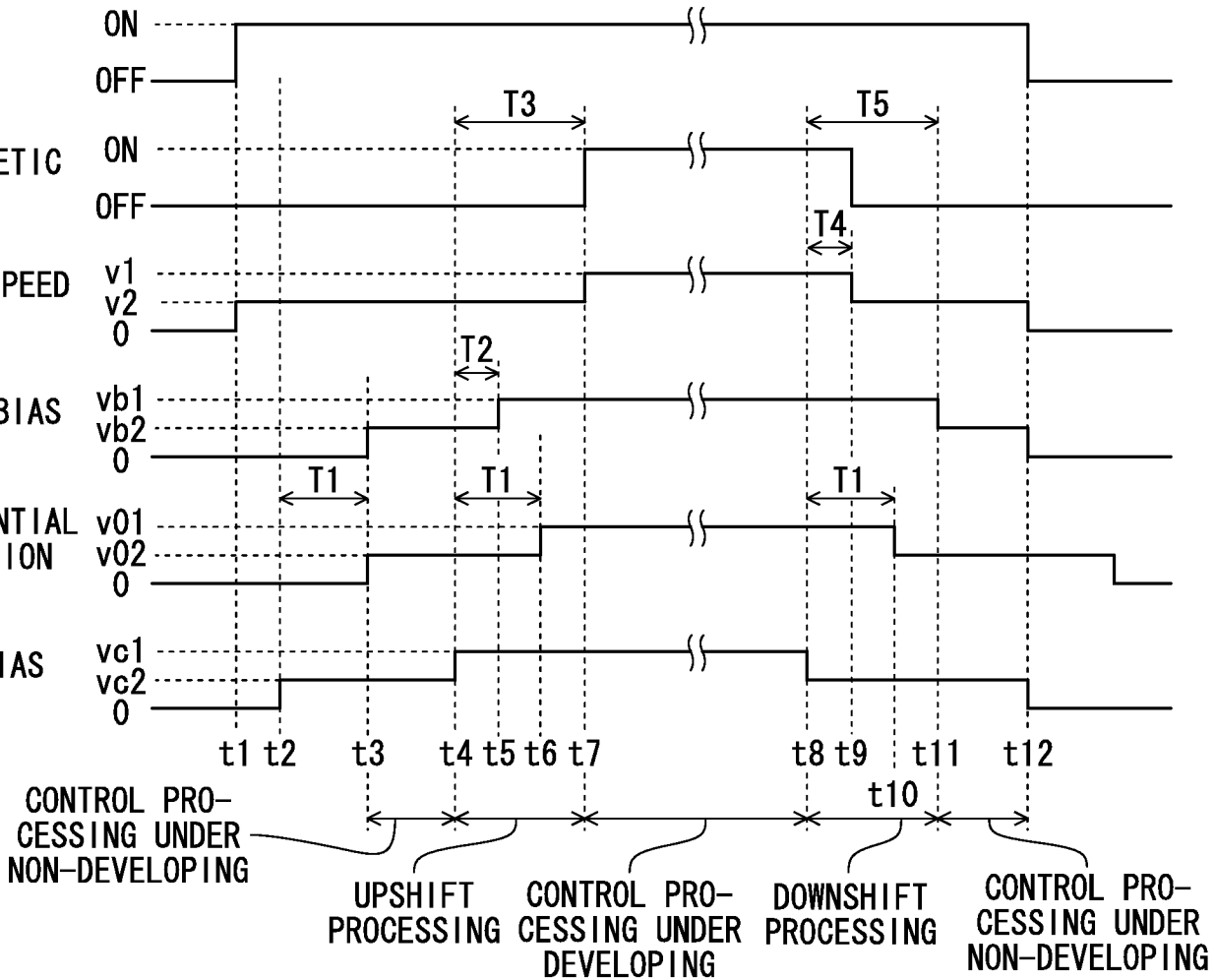

Subsequently, the timings of the respective processing are described in detail with reference to a timing chart shown in FIG. 8. In FIG. 8, for convenience sake, the upshift processing and the downshift processing are enlarged in terms of time for comparison with the control processing under developing and the control processing under non-developing.

As shown in FIG. 8, in response to receiving the print command, the second control unit 320 first turns on the motor 210 to switch the peripheral speed v from zero (0) to the low peripheral speed v2 (time t1). After that, the second control unit 320 switches the charging bias Vc from zero (0) to the low charging bias Vc2 (time t2).

In response to determining that the first time period T1 elapses from time t2, the surface potential V0 of the photosensitive drum 27 at the nip portion NP is switched from zero (0) to the low surface potential V02, and the second control unit 320 switches the developing bias Vb from zero (0) to the low developing bias Vb2 (time t3). Thereby, a preliminary rotation mode (control processing under non-developing) is enabled to start.

When the preliminary rotation mode is over, the first control unit 310 switches the charging bias Vc from the low charging bias Vc2 to the high charging bias Vc1 (time t4). In response to determining that the second time period T2 elapses from time t4, the first control unit 310 switches the developing bias Vb from the low developing bias Vb2 to the high developing bias Vb1 (time t5). In response to determining that time (T1−T2) elapses from time t5, i.e., in response to determining that the first time period T1 from time t4 to time at which the high potential part P3 reaches the nip portion NP elapses, the surface potential V0 of the photosensitive drum 27 at the nip portion NP is switched from the low surface potential V02 to the high surface potential V01 (time t6).

In response to determining that time (T3−T1) elapses from time t6, i.e., in response to determining that the third time period T3 elapses from time t4, the first control unit 310 turns on the electromagnetic clutch 223 to switch the peripheral speed v from the low peripheral speed v2 to the high peripheral speed v1 (time t7). Thereby, the control processing under developing including the printing control (developing control) is enabled to start.

After the printing control is over, the second control unit 320 switches the charging bias Vc from the high charging bias Vc1 to the low charging bias Vc2 (time t8). In response to determining that the fourth time period T4 elapses from time t8, the second control unit 320 turns off the electromagnetic clutch 223 to switch the peripheral speed v from the high peripheral speed v1 to the low peripheral speed v2 (time t9).

In response to determining that time (T1−T4) elapses from time t9, i.e., in response to determining that the first time period T1 elapses from time t8, the surface potential V0 of the photosensitive drum 27 at the nip portion NP is switched from the high surface potential V01 to the low surface potential V02 (time t10). In response to determining that time (T5−T1) elapses from time t10, i.e., in response to determining that the fifth time period T5 elapses from time t8, the second control unit 320 switches the developing bias Vb from the high developing bias Vb1 to the low developing bias Vb2 (time t11). Thereby, the ending rotation mode (control processing under non-developing) is enabled to start.

When ending the ending rotation mode, the second control unit 320 turns off the motor 210 and sets the respective biases to zero (0) (time t12).

According to the above illustrative embodiment, it is possible to accomplish the following effects. In the following descriptions, the effects are described with reference to a test result shown in FIG. 9.

The test result shown in FIG. 9 indicates whether press fogging occurs or not at a room temperature and low humidity (NL) environment and reverse polarity fogging occurs or not at a high temperature and high humidity (HH) environment when the surface potential V0 of the photosensitive drum 27, the developing bias Vb, and the peripheral speed v are appropriately changed. Here, the reverse polarity fogging indicates a phenomenon that the negatively charged toner due to the friction charging partially occurs and moves from the developing roller 100 to the non-image area (area in which the electrostatic latent image is not formed) of the photosensitive drum 27. The negatively charged toner due to the friction charging is increased in the high temperature and high humidity environment.

The description 'the peripheral speed v is rapid (high)' indicates the 'rapid peripheral speed' in terms of the peripheral speed of the photosensitive drum 27, and the description 'the peripheral speed v is slow (low)' indicates the 'slow peripheral speed' in terms of the peripheral speed of the photosensitive drum 27. Also, the room temperature is within a range of 15° C. or higher and lower than 28° C. In the test, the room temperature is set to 25° C. Also, the low humidity is a humidity of 30% or lower. In the test, the low humidity is set to 10%. Also, the high temperature is a temperature of 28° C. or higher. In the test, the high temperature is set to 32.5° C.

Also, the high humidity is a humidity of 60% or higher. In the test, the high humidity is set to 80%.

Also, the press fogging and the reverse polarity fogging are evaluated by rotating the photosensitive drum 27 and the developing roller 100 for a predetermined time period at a state where the photosensitive drum 27 is not exposed and then visually inspecting the non-image area of the photosensitive drum 27. In FIG. 9, a symbol "○-(one circle symbol and one dash symbol)" indicates a boundary line of a limit within which the influence of the press fogging or the reverse polarity fogging on the image formation is allowed. Based on this, the more the number of the symbols "○ (circle symbol)", such as "○, ○○, ○○○", indicates that the press fogging or the reverse polarity fogging has less influence on the image formation. Also, a symbol "x" indicates that influence of the press fogging or the reverse polarity fogging on the image formation is high.

Also, in FIG. 9, states C1 to C8 indicate states of the surface potential V0, the developing bias Vb and the peripheral speed v. For example, in the state C1, the surface potential V0 is the high surface potential V01 (850V), the developing bias Vb is the high developing bias Vb1 (400V), and the peripheral speed v is the high peripheral speed v1 (rapid). That is, the state C1 is a state during the control processing under developing, the state C8 is a state during the control processing under non-developing, and the states C2 to C7 are respective states during the upshift processing or during the downshift processing (hereinafter, the time period during the upshift processing and the time period during the downshift processing are collectively referred to as a time period during shift processing).

In the test result, it is confirmed that the influence of the press fogging is less in the lower developing bias Vb (200V) than in the higher developing bias Vb (400V) and the influence of the press fogging is less in the slow peripheral speed v than in the rapid peripheral speed v. For this reason, like the above illustrative embodiment, when the developing bias Vb is set to the low developing bias Vb2 and the peripheral speed of the developing roller 100 is set to the low peripheral speed v2 for a predetermined time period during the non-developing, it is possible to favorably suppress the press fogging for a predetermined time period during the non-developing, as compared to a configuration where the peripheral speed of the developing roller 100 is maintained at the high peripheral speed v1 for the predetermined time period during the non-developing, for example.

Also, in the test result, it is confirmed that when the surface potential V0 is 850V and the developing bias Vb is 200V in the high temperature and high humidity environment, the influence of the reverse polarity fogging is high. Thereby, it is confirmed that it is preferable not to form the states C3, C4 during the shift processing in the high temperature and high humidity environment.

Also, in the test result, it is confirmed that when the surface potential V0 is 650V, the developing bias Vb is 400V and the peripheral speed v is high in the room temperature and normal humidity environment, the influence of the press fogging is high. Thereby, it is confirmed that it is preferable not to form the state C5 during the shift processing in the room temperature and normal humidity environment.

Considering the above results, in the illustrative embodiment, when shifting from the control processing under non-developing (state C8) to the control processing under developing (state C1), the switching is made in order of the developing bias Vb-->the surface potential V0 at the nip portion NP-->the peripheral speed v. Thereby, when shifting from the control processing under non-developing to the control processing under developing, the switching is made in order of the state C8-->C6-->C2-->C1, so that it is possible to avoid the states C3 to C5 and to suppress the press fogging and the reverse polarity fogging.

Also, according to the illustrative embodiment, when shifting from the control processing under developing to the control processing under non-developing, the switching is made in order of the peripheral speed v-->the surface potential V0 at the nip portion NP-->the developing bias Vb. Thereby, when shifting from the control processing under developing to the control processing under non-developing, the switching is made in order of the state C1-->C2-->C6-->C8, so that it is possible to avoid the states C3 to C5 and to suppress the press fogging and the reverse polarity fogging.

Also, in the test result, it is confirmed that as a potential difference (V0−Vb) between the surface potential V0 of the photosensitive drum 27 and the developing bias Vb increases, the press fogging is more difficult to occur and the reverse polarity fogging is more likely to occur. Also, it is confirmed that as the potential difference (V0−Vb) decreases, the press fogging is more likely to occur and the reverse polarity fogging is more difficult to occur.

According to the illustrative embodiment, when shifting from the control processing under non-developing to the control processing under developing, the switching of the peripheral speed v is completed before the electrostatic latent image forming area on the photosensitive drum 27 reaches the developing roller 100. Therefore, it is possible to suppress the unfavorable supply of the toner from the developing roller 100 to the electrostatic latent image on the photosensitive drum 27, which is caused due to the switching of the peripheral speed v, so that it is possible to suppress the deterioration of an image quality of an image to be formed on the sheet 3.

Also, when shifting from the control processing under developing to the control processing under non-developing, the peripheral speed v is switched after the electrostatic latent image forming area on the photosensitive drum 27 exits from the developing roller 100. Therefore, it is possible to suppress the unfavorable supply of the toner from the developing roller 100 to the electrostatic latent image on the photosensitive drum 27, which is caused due to the switching of the peripheral speed v, so that it is possible to suppress the deterioration of an image quality of an image to be formed on the sheet 3.

The present disclosure is not limited to the above illustrative embodiment and can be variously implemented, as exemplified in the following. In the following, the substantially same configurations as the illustrative embodiment are denoted with the same reference numerals and the descriptions thereof are omitted.

In the above illustrative embodiment, when shifting from the control processing under non-developing to the control processing under developing, the switching is made in order of the developing bias Vb-->the surface potential V0 at the nip portion NP, and when shifting from the control processing under developing to the control processing under non-developing, the switching is made in order of the surface potential V0 at the nip portion NP-->the developing bias Vb. However, the present disclosure is not limited thereto. For example, when the temperature or humidity is equal to or lower than a predetermined value, the developing bias Vb and the surface potential V0 may be switched in an opposite order to the above illustrative embodiment.

Figure 10:
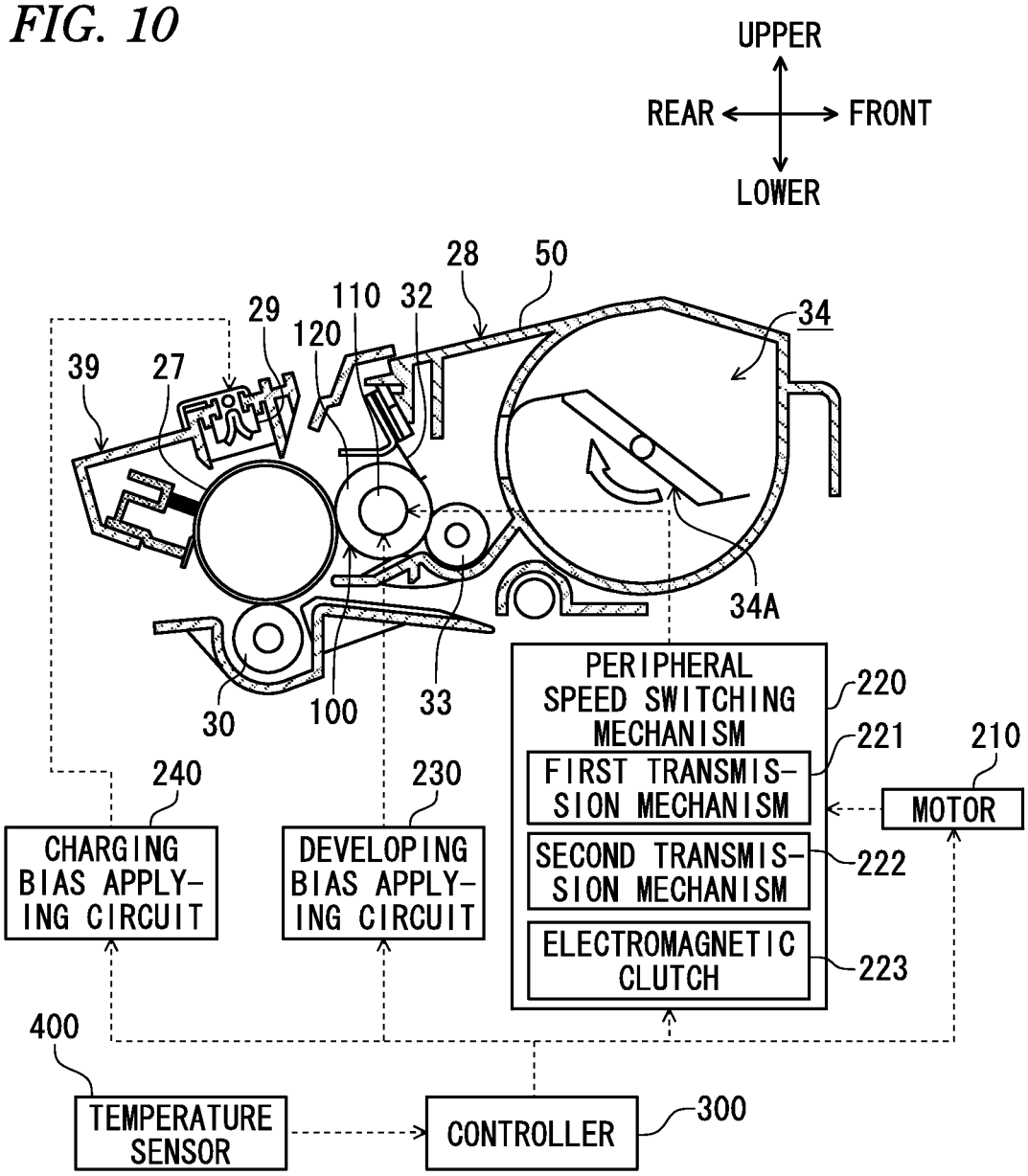
FIG. 10 illustrates a modified embodiment in which a laser printer is provided with a temperature sensor.

Specifically, as shown in FIG. 10, when the laser printer 1 is provided with a temperature sensor 400, which is an example of the sensor configured to transmit a signal resulting from the detected temperature to the controller 300, the developing bias Vb and the surface potential V0 may be switched in an opposite order to the above illustrative embodiment, on condition that a temperature TH detected by the temperature sensor 400 is equal to or smaller than a predetermined value TH1. Here, the predetermined value TH1 may be set to the upper limit of the room temperature range. Specifically, the controller 300 is configured to perform the control in accordance with flowcharts shown in FIGS. 11 and 12.

Figure 11:
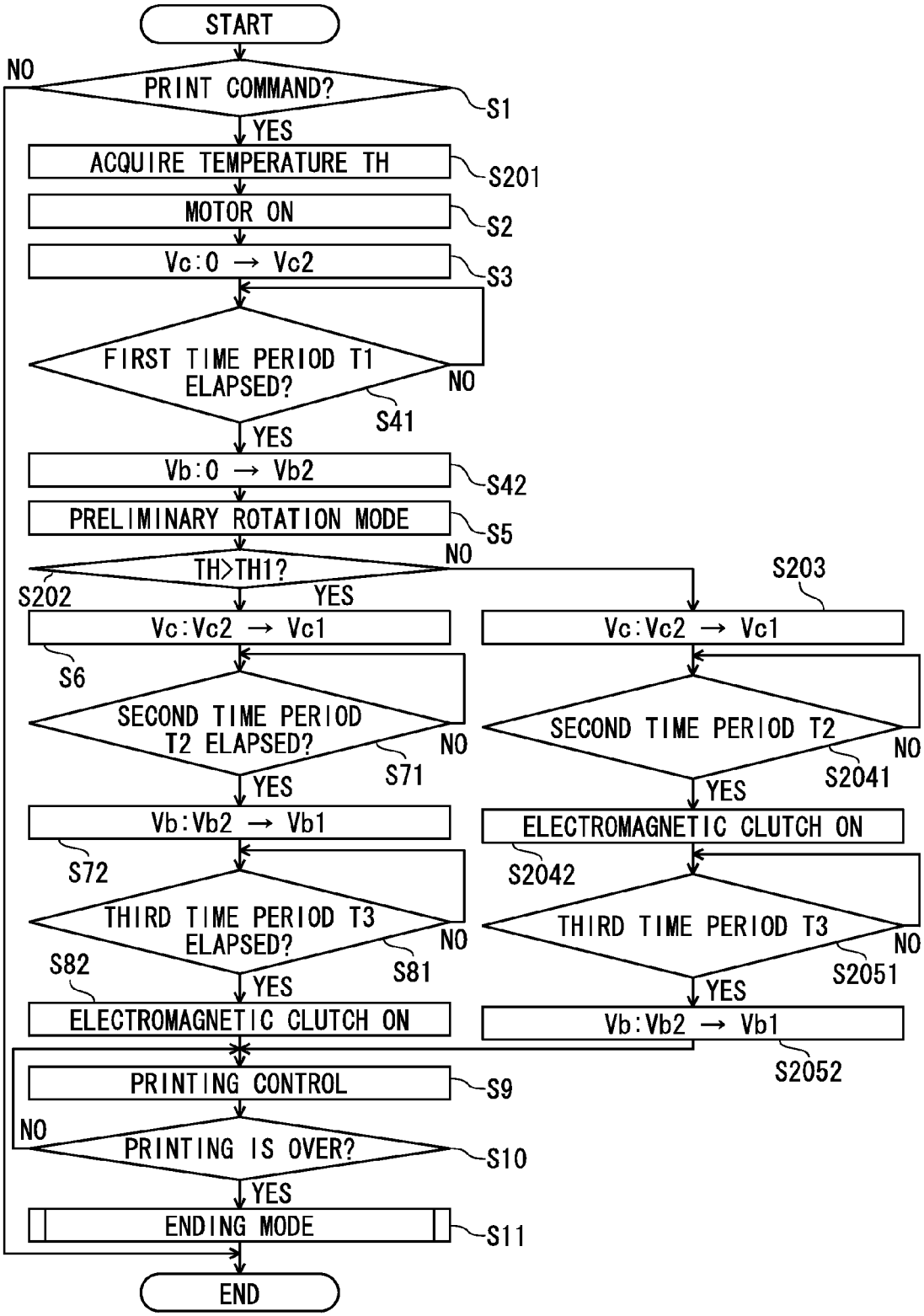
FIG. 11 is a flowchart showing operations of the controller of the modified embodiment.

In the flowchart of FIG. 11, new steps S201 to S2052 are added to the flowchart of FIG. 4. The step S201 is provided between step S1 and step S2. In step S201, the first control unit 310 and the second control unit 320 acquire a temperature TH detected by the temperature sensor 400.

The step S202 is provided between step S5 and step S6. In step S202, the first control unit 310 determines whether the temperature TH is larger than the predetermined value TH1.

In response to determining in step S202 that the temperature TH is larger than the predetermined value TH1 (S202: Yes), the first control unit 310 proceeds to the processing of step S6. In response to determining in step S202 that the temperature TH is equal to or smaller than the predetermined value TH1 (S202: No), the first control unit 310 switches the charging bias Vc from the low charging bias Vc2 to the high charging bias Vc1 (S203).

After step S203, the first control unit 310 determines whether the second time period T2 elapses from the switching of the charging bias Vc in step S203 (S2041).

In response to determining in step S2041 that the second time period T2 elapses from the switching of the charging bias Vc in step S203, the first control unit 310 turns on the electromagnetic clutch 223 to switch the peripheral speed v from the low peripheral speed v2 to the high peripheral speed v1 (S2042). Here, the second time period T2 is the same time as that described in the illustrative embodiment. For this reason, in steps S2041 and S2042, the peripheral speed v is switched before the high potential part P3 reaches the nip portion NP (refer to FIG. 5D).

After step S2042, the first control unit 310 determines whether the third time period T3 elapses from the switching of the charging bias Vc in step S203 (S2051).

In response to determining in step S2051 that the third time period T3 elapses from the switching of the charging bias Vc in step S203, the first control unit 310 switches the developing bias Vb from the low developing bias Vb2 to the high developing bias Vb1 (S2052). Here, the third time period T3 is the same time as that described in the illustrative embodiment. For this reason, in steps S2051 and S2052, the developing bias Vb is switched after the high potential part P3 reaches the nip portion NP (refer to FIG. 5E). In the meantime, after step S2052, the first control unit 310 proceeds to the processing of step S9.

Figure 12:
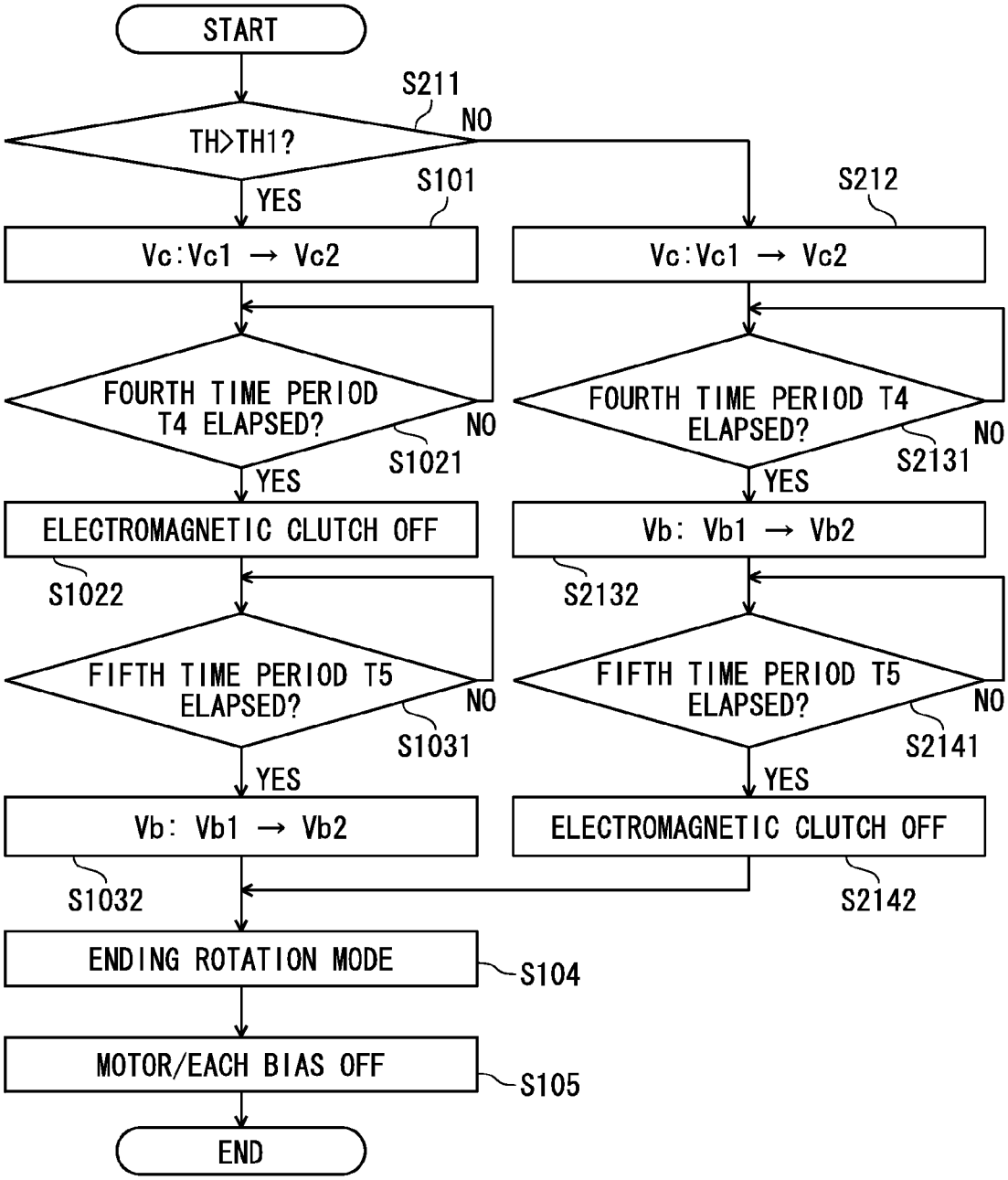
FIG. 12 is a flowchart showing the ending mode of the modified embodiment.

In the flowchart of FIG. 12, new steps S211 to S2142 are added to the flowchart of FIG. 6. The step S211 is provided before step S101.

In step S211, the second control unit 320 determines whether the temperature TH is larger than the predetermined value TH1. In response to determining in step S211 that the temperature TH is larger than the predetermined value TH1 (S211: Yes), the second control unit 320 proceeds to the processing of step S101.

In response to determining in step S211 that the temperature TH is equal to or smaller than the predetermined value TH1 (S211: No), the second control unit 320 switches the charging bias Vc from the high charging bias Vc1 to the low charging bias Vc2 (S212).

After step S212, the second control unit 320 determines whether the fourth time period T4 elapses from the switching of the charging bias Vc in step S212 (S2131).

In response to determining in step S2131 that the fourth time period T4 elapses from the switching of the charging bias Vc in step S212, the second control unit 320 switches the developing bias Vb from the high developing bias Vb1 to the low developing bias Vb2 (S2132).

Here, the fourth time period T4 is the same time as that described in the illustrative embodiment. For this reason, in steps S2131 and S2132, the developing bias Vb is switched before the low potential part P4 reaches the nip portion NP (refer to FIG. 7B).

After step S2132, the second control unit 320 determines whether the fifth time period T5 elapses from the switching of the charging bias Vc in step S212 (S2141).

In response to determining in step S2141 that the fifth time period T5 elapses from the switching of the charging bias Vc in step S212, the second control unit 320 turns off the electromagnetic clutch 223 to switch the peripheral speed v from the high peripheral speed v1 to the low peripheral speed v2 (S2142). Here, the fifth time period T5 is the same time as that described in the illustrative embodiment. For this reason, in steps S2141 and S2142, the peripheral speed v is switched after the low potential part P4 reaches the nip portion NP (refer to FIG. 7C). In the meantime, after step S2142, the second control unit 320 proceeds to the processing of step S104.

According to the above example, if the temperature TH is equal to or smaller than the predetermined value TH1, i.e., at the room temperature, when shifting from the control processing under non-developing to the control processing under developing, the switching is made in order of the peripheral speed v-->the surface potential V0 at the nip portion NP-->the developing bias Vb, and when shifting from the control processing under developing to the control processing under non-developing, the switching is made in order of the developing bias Vb-->the surface potential V0 at the nip portion NP-->the peripheral speed v. Thereby, as shown in FIG. 9, at the room temperature, when shifting from the control processing under non-developing to the control processing under developing, the state is switched in order of the state C8-->C7-->C3-->C1, and when shifting from the control processing under developing to the control processing under non-developing, the state is switched in order of the state C1-->C3-->C7-->C8. For this reason, it is possible to avoid the states C5, C6 at the room temperature, so that it is possible to suppress the press fogging at the room temperature, more favorably.

The sensor is not limited to the temperature sensor 400 and may be a humidity sensor configured to detect the humidity, a temperature-humidity sensor configured to detect both the temperature and the humidity, and the like. In the meantime, when using the humidity sensor, the temperature TH of FIGS. 11 and 12 is changed to the humidity and the predetermined value TH1 is changed to a value relating to the humidity.

In the above illustrative embodiment, the developing bias Vb, the peripheral speed v and the surface potential V0 are not switched at the same time during the shift processing. However, the present disclosure is not limited thereto. For example, at least two parameters of the respective parameters such as the developing bias Vb, the peripheral speed v and the surface potential V0 may be switched at the same time.

However, for example, when shifting from the control processing under non-developing to the control processing under developing, in case that the developing bias Vb is switched at a point of time that the surface potential V0 at the nip portion NP is switched (at a point of time that the downstream end of the high potential part P3 reaches the developing roller 100), if the surface potential V0 is switched before the developing bias Vb is switched, due to an error and the like, the state may shift from the state C8 to the state C4, so that the reverse polarity fogging may occur. In contrast, according to the order of the above illustrative embodiment, when shifting from the control processing under non-developing to the control processing under developing, the developing bias Vb is switched before the switching of the surface potential V0, so that it is possible to favorably suppress the reverse polarity fogging.

Also, when shifting from the control processing under non-developing to the control processing under developing, for example, in case that the developing bias Vb is switched (state C8-->C6) before the surface potential V0 at the nip portion NP is switched (before the high potential part P3 reaches the nip portion NP) and then the peripheral speed v is switched (state C6-->state C1) at a point of time that the surface potential V0 is switched, if the peripheral speed v is switched before the switching of the surface potential V0, due to an error and the like, the state may shift from the state C6 to the state C5, so that the press fogging may occur. In contrast, according to the order of the above illustrative embodiment, when shifting from the control processing under non-developing to the control processing under developing, the peripheral speed v is switched after the switching of the surface potential V0, so that it is possible to favorably suppress the press fogging.

Also, for example, when shifting from the control processing under developing to the control processing under non-developing, in case that the developing bias Vb is switched (state C2-->C8) at a point of time that the surface potential V0 at the nip portion NP is switched (the downstream end of the low potential part P4 reaches the developing roller 100), if the developing bias Vb is switched before the switching of the surface potential V0, due to an error and the like, the state may shift from the state C2 to the state C4, so that the reverse polarity fogging may occur. In contrast, according to the order of the above illustrative embodiment, when shifting from the control processing under developing to the control processing under non-developing, the developing bias Vb is switched after the switching of the surface potential V0, so that it is possible to favorably suppress the reverse polarity fogging.

Also, for example, when shifting from the control processing under developing to the control processing under non-developing, in case that the peripheral speed v is switched (state C1-->C6) at a point of time that the surface potential V0 at the nip portion NP is switched (the low potential part P4 reaches the developing roller 100), if the surface potential V0 is switched before the switching of the peripheral speed v, due to an error and the like, the state may shift from the state C1 to the state C5, so that the press fogging may occur. In contrast, according to the order of the above illustrative embodiment, when shifting from the control processing under developing to the control processing under non-developing, the peripheral speed v is switched before the switching of the surface potential V0, so that it is possible to favorably suppress the press fogging.

In the meantime, when shifting from the control processing under non-developing to the control processing under developing, if the surface potential V0 and the developing bias Vb are switched at the same time, it is possible to avoid the states C3 to C5 even though the peripheral speed v is switched before the switching thereof. However, also in this case, it is preferable to switch the peripheral speed v at the same time as or after the switching of the surface potential V0 and the like. The reason is that the influence of the pressing fogging is less at the slow peripheral speed v than at the rapid peripheral speed v (for example, refer to the state C1 and the state C2), as shown in the test result of FIG. 9. For this reason, according to the method of switching the peripheral speed v at the same time as or after the switching of the surface potential V0 and the like, when shifting from the control processing under non-developing to the control processing under developing, it is possible to delay the timing at which the peripheral speed v becomes fast, as compared to the method of switching the peripheral speed v before the switching of the surface potential V0 and the like, so that it is possible to suppress the press fogging.

Also, likewise, when shifting from the control processing under developing to the control processing under non-developing, if the surface potential V0 and the developing bias Vb are switched at the same time, it is possible to avoid the states C3 to C5 even though the peripheral speed v is switched after the switching thereof. However, also in this case, it is preferable to switch the peripheral speed v at the same time as or before the switching of the surface potential V0 and the like because of the above reason. According to this method, when shifting from the control processing under developing to the control processing under non-developing, it is possible to make the timing at which the peripheral speed v slows down faster, as compared to the method of switching the peripheral speed v after the switching of the surface potential V0 and the like, so that it is possible to suppress the press fogging.

In the above illustrative embodiment, the rotating speed of the photosensitive drum 27 is set to be constant in the control processing under developing and the control processing under non-developing. However, the present disclosure is not limited thereto. For example, the rotating speed (peripheral speed) of the photosensitive drum may be changed in two stages or more in the control processing under developing and the control processing under non-developing. Meanwhile, in this case, the peripheral speed of the developing roller or photosensitive drum may be changed so that the peripheral speed ratio of the developing roller to the photosensitive drum becomes a large peripheral speed ratio in the control processing under developing, and becomes a small peripheral speed ratio smaller than the large peripheral speed ratio and larger than zero (0) in the control processing under non-developing.

In the above illustrative embodiment, the present disclosure is applied to the laser printer 1 in which the positively charged toner is used. However, the present disclosure is not limited thereto. For example, the present disclosure can also be applied to a laser printer in which negatively charged toner is used. That is, the developing bias and the charging bias may be the negative biases.

In the above illustrative embodiment, the present disclosure is applied to the laser printer 1. However, the present disclosure is not limited thereto. For example, the present disclosure can also be applied to the other image forming apparatuses such as a copier and a multi function device.

In the above illustrative embodiment, the photosensitive drum 27 has been exemplified as the photosensitive member. However, the present disclosure is not limited thereto. For example, a belt-type photosensitive member may also be used. The charger is not limited to the scorotron-type charger 29 of the illustrative embodiment, and may be a scorotron-type charger, a charging roller configured to contact and charge the photosensitive member, and the like.

In the above illustrative embodiment, the sheet 3 such as a cardboard, a postcard, thin paper and the like has been exemplified as the recording sheet. However, the present disclosure is not limited thereto. For example, an OHP sheet may also be used.

What is claimed is:

1. An image forming apparatus comprising:

an image forming unit comprising:

a photosensitive member on which an electrostatic latent image is to be formed;

a charger configured to charge the photosensitive member; and a developing roller configured to contact the photosensitive member and to supply developer to the electrostatic latent image formed on the photosensitive member;

a peripheral speed setting mechanism configured to set a peripheral speed ratio of the developing roller to the photosensitive member to at least a small peripheral speed ratio and a large peripheral speed ratio;

a developing bias applying circuit configured to selectively apply a low developing bias or high developing bias to the developing roller;

a charging bias applying circuit configured to selectively apply a low charging bias or high charging bias to the charger; and a controller configured to:

control, the peripheral speed setting mechanism to set the peripheral speed ratio to the small peripheral speed ratio in rotating the developing roller;

control the developing bias applying circuit to apply the low developing bias to the developing roller for a predetermined time period;

control the developing bias applying circuit to operate in a state in which the high developing bias is applied to the developing roller and the peripheral speed setting mechanism to set the peripheral speed ratio to the large peripheral speed ratio after controlling the peripheral speed setting mechanism to set the peripheral speed ratio to the small peripheral speed ratio and the developing bias applying circuit to apply the low developing bias to the developing roller for the predetermined time period;

control the charging bias applying circuit to switch from applying the low charging bias to applying the high charging bias to the charger;

determine whether a first preset time period elapses after switching from applying the low charging bias to applying the high charging bias to the charger;

control the developing bias applying circuit to switch from applying the low developing bias to applying the high developing bias to the developing roller in response to determining that the first preset time period elapses after switching from applying the low charging bias to applying the high charging bias to the charger; and control the image forming unit to supply the developer to the electrostatic latent image formed on the photosensitive member and to transfer the developer on the photosensitive member to a sheet after controlling the developing bias applying circuit to operate in a state in which the high developing bias is applied to the developing roller and the peripheral speed setting mechanism to set the peripheral speed ratio to the large peripheral speed ratio, wherein the low developing bias is set to have an absolute value smaller than the high developing bias and larger than zero, wherein the small peripheral speed ratio is set to be smaller than the large peripheral speed ratio and to be larger than zero, wherein the low charging bias is set to have an absolute value smaller than the high charging bias and larger than zero, and wherein the first preset time period is set to be shorter than a time period for which a high potential part reaches the developing roller, the high potential part being formed on a surface of the photosensitive member at a position facing the charger.

2. The image forming apparatus according to claim 1, wherein the controller is configured to:

control the developing bias applying circuit to operate in a state in which the high developing bias is applied to the developing roller by switching from applying the low developing bias to applying the high developing bias to the developing roller.

3. The image forming apparatus according to claim 1, wherein the controller is configured to:

control the peripheral speed setting mechanism to switch the peripheral speed ratio from the small peripheral speed ratio to the large peripheral speed ratio before an electrostatic latent image forming area reaches the developing roller, the electrostatic latent image forming area being formed on the photosensitive member to correspond to an image forming area of the sheet.

4. The image forming apparatus according to claim 1, wherein a rotating speed of the photosensitive member is set to be constant and the same during a developing process and during a non-developing process, the developing process during which the developing roller is applied with the high developing bias, and the non-developing process during which the developing roller is applied with the low developing bias.

5. The image forming apparatus according to claim 1, further comprising:

a sensor configured to detect at least one of a temperature and a humidity, wherein the controller is configured to:

determine whether the temperature or the humidity detected by the sensor is equal to or lower than a predetermined threshold value;

control the charging bias applying circuit to switch from applying the low charging bias to applying the high charging bias to the charger in response to determining that the temperature or humidity detected by the sensor is equal to or lower than the predetermined threshold value;

determine whether the first preset time period elapses after switching from applying the low charging bias to applying the high charging bias to the charger; and control the developing bias applying circuit to switch from applying the low developing bias to applying the high developing bias to the developing roller in response to determining that the first preset time period elapses.

6. An image forming apparatus comprising an image forming unit comprising:

a photosensitive member on which an electrostatic latent image is to be formed;

a charger configured to charge the photosensitive member; and a developing roller configured to contact the photosensitive member and to supply developer to the electrostatic latent image formed on the photosensitive member;

a peripheral speed setting mechanism configured to set a peripheral speed ratio of the developing roller to the photosensitive member to at least a small peripheral speed ratio and a large peripheral speed ratio;

a developing bias applying circuit configured to selectively apply a low developing bias or high developing bias to the developing roller;

a charging bias applying circuit configured to selectively apply a low charging bias or high charging bias to the charger; and a controller configured to:

control, the peripheral speed setting mechanism to set the peripheral speed ratio to the small peripheral speed ratio in rotating the developing roller;

control the developing bias applying circuit to apply the low developing bias to the developing roller for a predetermined time period;

control the developing bias applying circuit to operate in a state in which the high developing bias is applied to the developing roller and the peripheral speed setting mechanism to set the peripheral speed ratio to the large peripheral speed ratio after controlling the peripheral speed setting mechanism to set the peripheral speed ratio to the small peripheral speed ratio and the developing bias applying circuit to apply the low developing bias to the developing roller for the predetermined time period;

control the charging bias applying circuit to switch from applying the low charging bias to applying the high charging bias to the charger;

determine whether a first preset time period elapses after switching from applying the low charging bias to applying the high charging bias to the charger;

control the developing bias applying circuit to switch from applying the low developing bias to applying the high developing bias to the developing roller in response to determining that the first preset time period elapses after switching from applying the low charging bias to applying the high charging bias to the charger;

control the image forming unit to supply the developer to the electrostatic latent image formed on the photosensitive member and to transfer the developer on the photosensitive member to a sheet after controlling the developing bias applying circuit to operate in a state in which the high developing bias is applied to the developing roller and the peripheral speed setting mechanism to set the peripheral speed ratio to the large peripheral speed ratio;

determine whether a second preset time period elapses after switching from applying the low charging bias to applying the high charging bias to the charger; and control the peripheral speed setting mechanism to switch the peripheral speed ratio from the small peripheral speed ratio to the large peripheral speed ratio in response to determining that the second preset time period elapses, wherein the low developing bias is set to have an absolute value smaller than the high developing bias and larger than zero, wherein the small peripheral speed ratio is set to be smaller than the large peripheral speed ratio and to be larger than zero, and wherein the low charging bias is set to have an absolute value smaller than the high charging bias and larger than zero.

7. The image forming apparatus according to claim 6, wherein the second preset time period is set to be equal to or longer than a time period for which a high potential part reaches the developing roller, the high potential part formed on a surface of the photosensitive member at a position facing the charger.

8. The image forming apparatus according to claim 6, wherein a rotating speed of the photosensitive member is set to be constant and the same during a developing process and during a non-developing process, the developing process during which the developing roller is applied with the high developing bias, and the non-developing process during which the developing roller is applied with the low developing bias.

9. The image forming apparatus according to claim 6, further comprising:

a sensor configured to detect at least one of a temperature and a humidity, wherein the controller is configured to:

determine whether the temperature or the humidity detected by the sensor is equal to or lower than a predetermined threshold value;

control the charging bias applying circuit to switch from applying the low charging bias to applying the high charging bias to the charger in response to determining that the temperature or humidity detected by the sensor is equal to or lower than the predetermined threshold value;

determine whether the first preset time period elapses after switching from applying the low charging bias to applying the high charging bias to the charger; and control the developing bias applying circuit to switch from applying the low developing bias to applying the high developing bias to the developing roller in response to determining that the first preset time period elapses.

10. An image forming apparatus comprising:

an image forming unit comprising:

a photosensitive member on which an electrostatic latent image is to be formed;

a charger configured to charge the photosensitive member; and a developing roller configured to contact the photosensitive member and to supply developer to the electrostatic latent image formed on the photosensitive member;

a peripheral speed setting mechanism configured to set a peripheral speed ratio of the developing roller to the photosensitive member to at least a small peripheral speed ratio and a large peripheral speed ratio;

a developing bias applying circuit configured to selectively apply a low developing bias or high developing bias to the developing roller;

a charging bias applying circuit configured to selectively apply a low charging bias or high charging bias to the charger; and a controller configured to:

control, the peripheral speed setting mechanism to set the peripheral speed ratio to the small peripheral speed ratio in rotating the developing roller;

control the developing bias applying circuit to apply the low developing bias to the developing roller for a predetermined time period;

control the developing bias applying circuit to operate in a state in which the high developing bias is applied to the developing roller and the peripheral speed setting mechanism to set the peripheral speed ratio to the large peripheral speed ratio after controlling the peripheral speed setting mechanism to set the peripheral speed ratio to the small peripheral speed ratio and the developing bias applying circuit to apply the low developing bias to the developing roller for the predetermined time period;

control the image forming unit to supply the developer to the electrostatic latent image formed on the photosensitive member and to transfer the developer on the photosensitive member to a sheet after controlling the developing bias applying circuit to operate in a state in which the high developing bias is applied to the developing roller and the peripheral speed setting mechanism to set the peripheral speed ratio to the large peripheral speed ratio;

control the peripheral speed setting mechanism to switch the peripheral speed ratio from the large peripheral speed ratio to the small peripheral speed ratio; and control, after switching the peripheral speed ratio from the large peripheral speed ratio to the small peripheral speed ratio, the developing bias applying circuit to switch from applying the high developing bias to applying the low developing bias;

control the charging bias applying circuit to switch from applying the high charging bias to the low charging bias to the charger;

determine whether a third preset time period elapses after switching from applying the high charging bias to the low charging bias to the charger; and control the developing bias applying circuit to switch from applying the high developing bias to applying the low developing bias to the developing roller in response to determining that the third preset time period elapses, wherein the low developing bias is set to have an absolute value smaller than the high developing bias and larger than zero, wherein the small peripheral speed ratio is set to be smaller than the large peripheral speed ratio and larger than zero, wherein the low charging bias is set to have an absolute value smaller than the high charging bias and larger than zero, and wherein the third preset time period is set to be longer than a time period for which a low potential part reaches the developing roller, the low potential part being formed on a surface of the photosensitive member at a position facing the charger.

11. The image forming apparatus according to claim 10, wherein the controller is configured to:

determine whether a fourth preset time period elapses after switching from applying the high charging bias to the low charging bias to the charger; and control the peripheral speed setting mechanism to switch the peripheral speed ratio from the large peripheral speed ratio to the small peripheral speed ratio in response to determining that the fourth preset time period elapses.

12. The image forming apparatus according to claim 11, wherein the fourth preset time period is set to be shorter than a time period for which a low potential part reached the developing roller, the low potential part formed on a surface of the photosensitive member at a position facing the charger.

13. The image forming apparatus according to claim 10, wherein the controller is configured to:

control the peripheral speed setting mechanism to switch the peripheral speed ratio from the large peripheral speed ratio to the small peripheral speed ratio after an electrostatic latent image forming area exits the developing roller, the electrostatic latent image forming area being formed on the photosensitive member to correspond to an image forming area of the sheet.

14. The image forming apparatus according to claim 10, further comprising:

a sensor configured to detect at least one of a temperature and a humidity, wherein the controller is configured to:

determine whether the temperature or the humidity detected by the sensor is equal to or lower than a predetermined threshold value;

control the charging bias applying circuit to switch from applying the high charging bias to applying the low charging bias to the charger in response to determining that the temperature or humidity detected by the sensor is equal to or lower than the predetermined threshold value;

determine whether a fourth preset time period elapses after switching from applying the high charging bias to applying the low charging bias to the charger; and control the developing bias applying circuit to switch from applying the high developing bias to applying the low developing bias to the developing roller in response to determining that the fourth preset time period elapses.

15. The image forming apparatus according to claim 10, wherein a rotating speed of the photosensitive member is set to be constant and the same during a developing process and during a non-developing process, the developing process during which the developing roller is applied with the high developing bias, and the non-developing process during which the developing roller is applied with the low developing bias.

* * * * *